US007348512B2

(12) United States Patent
Iohara

(10) Patent No.: US 7,348,512 B2
(45) Date of Patent: Mar. 25, 2008

(54) KEY UNIT WITH REINFORCING PLATE

(75) Inventor: Yuichi Iohara, Koga (JP)

(73) Assignee: Sunarrow Limited, Tokyo (JP)

( * ) Notice: Subject to any disclaimer, the term of this patent is extended or adjusted under 35 U.S.C. 154(b) by 0 days.

(21) Appl. No.: 11/547,253

(22) PCT Filed: Mar. 7, 2005

(86) PCT No.: PCT/JP2005/003856

§ 371 (c)(1),
(2), (4) Date: Oct. 3, 2006

(87) PCT Pub. No.: WO2005/098884

PCT Pub. Date: Oct. 20, 2005

(65) Prior Publication Data

US 2007/0272534 A1 Nov. 29, 2007

(30) Foreign Application Priority Data

Apr. 5, 2004 (JP) ..... 2004-110730
Apr. 5, 2004 (JP) ..... 2004-110731

(51) Int. Cl.
*H01H 13/70* (2006.01)

(52) U.S. Cl. ..... 200/341; 200/308; 200/317; 341/22; 345/168; 345/169; 379/368; 379/433.07

(58) Field of Classification Search ..... 200/5 A, 200/512, 517, 308, 310, 314, 317, 341; 341/22; 345/168–170; 379/368, 433.07
See application file for complete search history.

(56) References Cited

U.S. PATENT DOCUMENTS 6,878,892 B2 * 4/2005 Miyako et al. ..... 200/310
6,967,292 B2 * 11/2005 Nishimura ..... 200/5 A
7,034,235 B2 * 4/2006 Hosaka ..... 200/314

(Continued)

FOREIGN PATENT DOCUMENTS

JP 63-18727 U 2/1988

(Continued)

*Primary Examiner*—Michael A. Friedhofer
(74) *Attorney, Agent, or Firm*—Frishauf, Holtz, Goodman & Chick, P.C.

(57) ABSTRACT

The object of the present invention is to utilize a reinforcing plate formed out of a metal or a hard resin introduced into a key unit in order to overcome the weak point that conventional rubber keypads are too soft and lack shape stability, as a design element of equipment including a key unit into which the plate is incorporated.

For example, a part of metal reinforcing plate 4 is positively exposed to a position which can be seen from the outside of key unit 1, and various decorations are applied to the exposed part 7 so as to allow it to function as a decorated component. As a location where the reinforcing plate is exposed, there can be cited a part between each key on the key face or an annular part which encircles a plurality of key clusters. A mode may be considered in which the part of the exposed reinforcing plate 4 surrounds each individual key top 2 like a key frame, so as to substitute a key frame which has been conventionally realized by the equipment casing. The shape of the exposed part of the reinforcing plate 4 is arbitrary. For example, letters, symbols, or the like may be formed.

6 Claims, 24 Drawing Sheets

U.S. PATENT DOCUMENTS

| | | | | |
|---|---|---|---|---|
| 7,038,152 | B2 * | 5/2006 | Watanabe | 200/314 |
| 7,041,924 | B2 * | 5/2006 | Jeschke et al. | 200/302.2 |
| 7,050,292 | B2 * | 5/2006 | Shimura et al. | 361/679 |
| 7,244,899 | B2 * | 7/2007 | Jung et al. | 200/314 |
| 7,250,937 | B2 * | 7/2007 | Takagi | 345/168 |
| 7,262,379 | B2 * | 8/2007 | Nishimura et al. | 200/314 |
| 7,266,194 | B2 * | 9/2007 | Saeki et al. | 379/368 |
| 2003/0109229 | A1 | 6/2003 | Takagi | |
| 2004/0200712 | A1 | 10/2004 | Nishimura et al. | |

FOREIGN PATENT DOCUMENTS

| | | | |
|---|---|---|---|
| JP | 1-281797 | A | 11/1989 |
| JP | 2681064 | B2 | 1/1991 |
| JP | 7-8927 | U | 2/1995 |
| JP | 7-245039 | A | 9/1995 |
| JP | 2003-178639 | A | 6/2003 |
| JP | 3099977 | U | 12/2003 |
| JP | 2004-327420 | A | 11/2004 |

* cited by examiner

KEY UNIT WITH REINFORCING PLATE

This application is a U.S. National Phase Application under 35 USC 371 of International Application PCT/JP2005/003856 filed Mar. 7, 2005.

TECHNICAL FIELD

The present invention relates to a key unit for use in mobile equipment such as portable phones and personal digital assistants (PDA), in particular, to a key unit with a reinforcing plate which imparts shape retention-ability to a rubber keypad using a hard plate material.

BACKGROUND ART

A key unit is a type of components constituting mobile equipment such as portable phones and personal digital assistants (PDA), and a unit in which a multiplicity of keys (push buttons) for switch operation are assembled and arrayed on a surface of a single sheet. A single key comprises a key top made of a hard resin adhered to the surface of flexible rubber keypads such as various rubbers including a silicone rubber or thermoplastic elastomers, and a switch-pressing projection (what is called "pressing element") formed on the back surface of the keypad corresponding to the position of the key top. When a circuit substrate provided with switch elements close contacts with the undersurface of the key unit configured in such manner, key switches are formed at the positions corresponding to each key.

However, the conventional rubber keypads are too soft and lack shape stability, which causes various disadvantages such as incapability of precisely maintaining gaps between key tops and difficulty for applying automatic assembly. In particular, when a casing is provided with a key frame in order to maintain gaps between the keys, such a new disadvantage occurs that the key tops do not return due to interference with the key frame.

In order to overcome these weak points, there is conceived of the configuration of adding a hard plate material (hereinafter, referred to as "reinforcing plate") to the keypad, so as to impart rigidity to the key unit itself instead of using the key frame which is provided on the casing, and the present applicant has filed a patent application with the title of "hard base key unit" (Patent Reference 1).

Patent Reference 1:

Japanese Unexamined Patent Publication No. 2003-178639

In the hard base key unit, usage of a rubber elastic body is limited only to a key operation part in a keypad, and other parts of the keypad are replaced with a hard resin plate for reinforcement. An aperture is provided at the position corresponding to the key operation part of the hard resin plate which serves as a reinforcing plate, and a rubber elastic body is jointed around the aperture. Further, there are also some alternative conditions that the rubber elastic body covers the whole top surface of the hard resin plate together with the aperture, or a rubber elastic body film enfolds the whole hard resin plate including the apertures.

However, the role of the reinforcing plate in Patent Reference 1 only remains imparting rigidity to the keypads and serving also as a light-conducting plate, and no idea is recognized such that the reinforcing plate is positively utilized for a design element of equipment.

Figure 1:
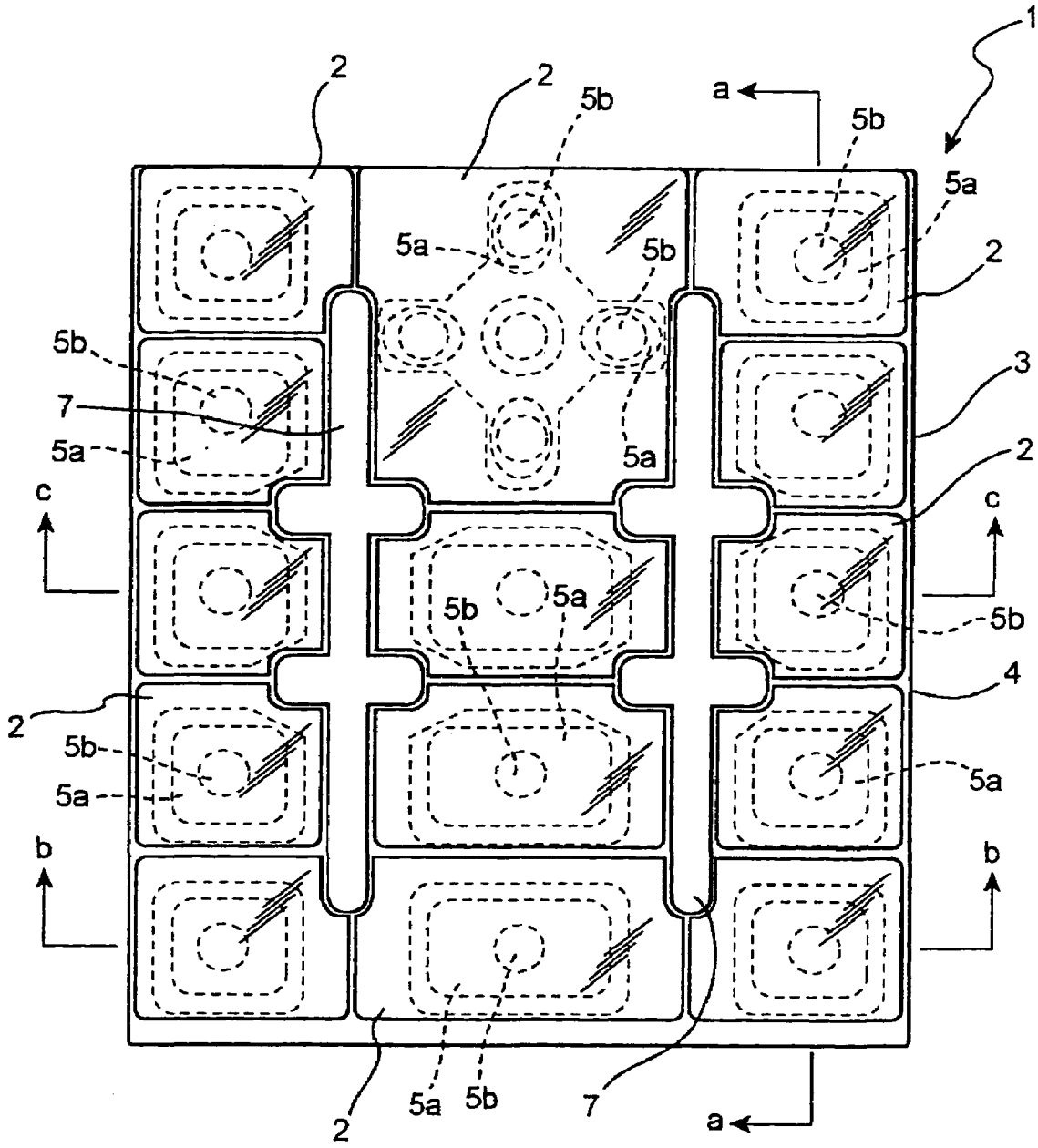
[FIG. 1]
Enlarged plan view showing a key unit with metal reinforcing plate as Embodiment 1.

Enlarged sectional view showing a decorative layer provided on the undersurface of the hard resin reinforcing plate, in the key unit with hard resin reinforcing plate as Embodiment 4.

[FIG. 23]

Enlarged sectional view showing a decorative layer provided on the top surface of the hard resin reinforcing plate, in the key unit with hard resin reinforcing plate as Embodiment 4.

[FIG. 24]

Longitudinal sectional view showing a modified example of the key unit with hard resin reinforcing plate as Embodiment 4.

[FIG. 25]

Plan view showing a key unit with hard resin reinforcing plate as Embodiment 5.

[FIG. 26]

Plan view showing a key unit with hard resin reinforcing plate as Embodiment 6.

[FIG. 27]

Longitudinal sectional view showing the key unit with hard resin reinforcing plate as Embodiment 6.

[FIG. 28]

Plan view showing a portable phone in which the key unit with hard resin reinforcing plate as Embodiment 6 is assembled.

DISCLOSURE OF THE INVENTION

Problems to be Solved by the Invention

The object to be achieved by the invention is to find measures for utilizing the above-mentioned reinforcing plate as a design element of the equipment including a key unit into which the plate is incorporated.

Means for Solving the Problems

Whereas the reinforcing plate disclosed in Patent Reference 1 occupies an area which cannot be seen from the outside of the key unit, the present invention intends to positively expose a part of the reinforcing plate at the site such as the key-arrayed surface or the like which can be seen from the outside of the key unit and apply various decorations to the exposed part, so as to allow it to function also as a decorated component.

EFFECT OF THE INVENTION

In the conventional key units, the portions to which a decoration can be applied (hereinafter, referred to simply as "decoration") are limited to the top surface, the side surface, and the back surface of the key top. However, the present invention allows to introduce a new element to enable the decoration, which broadens the flexibility of design. Further, the present invention can impart rigidity to the keypad; bring the effects such as the shape stability, the suitability for automatic assembly, the improvement of precision of the key top position or the like to the key unit; and allow the reinforcing plate to serve also as a light-conducting plate, which is equivalent to the hard base key unit disclosed previously.

BEST MODE FOR CARRYING OUT THE INVENTION

In the key unit with reinforcing plate of the present invention, as a material for forming a reinforcing plate, one or a plurality of metal materials selected from various noble metals and various alloys such as magnesium, aluminum, stainless steel, titanium, copper gold or the like, or a hard resin can be used. As a location for exposing the reinforcing plate, there can be cited a part between each key on the key face and an annular part which encircles one or a plurality of key clusters. A mode may be considered in which the part of the exposed reinforcing plate (hereinafter, referred to as "exposed part") surrounds each individual key top like a key frame, so as to substitute a key frame which has been conventionally realized by the equipment casing.

In the key unit with reinforcing plate of the present invention, as a location for exposing the reinforcing plate, there can be cited a part between each key on the key face and an annular part which encircles a plurality of key clusters. A mode may be considered in which the part of the exposed reinforcing plate surrounds each key top like a key frame, so as to substitute a key frame which has been conventionally realized by the equipment casing.

The shape of the exposed part is arbitrary. For example, letters, symbols or the like may be formed. In addition, a metal which can be a material for the reinforcing plate is not necessarily limited to a single kind. For example, even if a metal of the kind which lacks strength for forming the overall reinforcing plate has an advantage in designs such as hue when applied to a part to be exposed, the reinforcing plate may be formed using a plurality of metal materials.

When the reinforcing plate is made of a metal or a dark-colored hard resin, the plate basically cannot have translucency. However, if an appropriate aperture is provided at a part of the exposed part, light can be scattered through the aperture. In this case, the aperture provided at the exposed part is preferably filled with a translucent plastic or a rubber elastic body, in view of preventing humidity, dust or the like.

A part of or all of the exposed part may be translucent (colored or colorless), so that light may be scattered therethrough. In this case, a material for the reinforcing plate is preferably a hard resin which has excellent transparency such as PC (polycarbonate resin), PET (polyethylene terephthalate-resin), PMMA (polymethylmethacrylate/acrylate resin) or the like. It may be possible to perform multicolor molding using two or more kinds of resins including a colored resin or the like.

As a light source for use in the key unit with reinforcing plate of the present invention, there can be used an EL sheet in which generally used LED (light-emitting diode) or EL (electroluminescence) elements are formed in a sheet-like manner. When using the EL sheet, the arrangement may be considered in such a manner that the sheet may be attached to the back surface of the key top, or the sheet may be molded integrally with the reinforcing plate as well as attaching the sheet to the surface of a printed wiring board. Further, when using the EL element as a light source, it may be possible to form the EL element including an electrode and a light-emitting layer directly on the surface of the key top or the reinforcing plate by means of printing or the like. In particular, by using an EL sheet capable of multicolor luminescence, it is possible to illuminate a part of or all of the exposed part of each key and the reinforcing plate independently in each appropriately divided area, and with an arbitrary color.

Similar to the decoration to the key top, various methods can be employed to the exposed part of the reinforcing plate. For example, there are cited printing (including what is called hot stamping which is one type of thermal transfer printing methods), painting, or various film-forming methods (plating, CVD, vapor deposition, sputtering, ion plating or the like) using a metal or a nonmetal. In addition, in the same manner as each key, it is possible to illuminate the exposed part using light from the light source. Further, the surface of the exposed part may be coated with a sheet-like material such as a plastic film or the like, so that a single side or both sides of the sheet-like material may be decorated variously as well as direct decoration to a material which constitutes the exposed part.

When the reinforcing plate is made of a metal, it is possible to utilize the original texture and ground color of the material of the reinforcing plate by polishing the surface of its exposed part or the like. However, in this case, it is preferable that an appropriate transparent protective layer should be provided on the surface of the exposed part of the reinforcing plate, in order to cope with static electricity or prevent corrosion.

When the reinforcing plate is made of a resin, it is possible to form a keypad, not only by means of insert molding, but also by means of what is called dichromatic molding which is performed using the combination of silicone rubbers and hard resin materials, or the combination of various thermoplastic elastomers and hard resin materials.

EMBODIMENT 1

FIGS. 1 to 8 show Embodiment 1 of the key unit with metal reinforcing plate (hereinafter, referred to as merely "key unit") of the present invention. The present Embodiment 1 sets forth that a part of the metal reinforcing plate is exposed, in the shape of two inequality symbols, between key clusters which constitute three columns as a whole.

A key unit 1 has key tops 2, 2, . . . , and a keypad 3 which are formed in desired shapes. The key top 2 is formed out of a hard resin which has excellent transparency such as PC(polycarbonate resin), PET (polyethylene terephthalate resin) or PMMA polymethylmethacrylate/acrylate resin) The keypad 3 comprises a reinforcing plate 4 made of a metal in the form of a plate as a whole, and a pad member 5 constituting a key operation part. That is, the keypad 3 referred to as in the present specification is a composite member made of the metal reinforcing plate 4 and the pad member 5 made of a rubber elastic body. It should be added that for the key unit 1, what is called narrow pitch keys are employed in which a gap between each key top 2 is 0.3 mm or less (preferably about 0.1 mm).

The keypad 3 is formed, for example, by insert molding of the metal reinforcing plate 4 which has already been formed when the pad member 5 is molded. The metal reinforcing plate 4 is formed out of various metals and alloys such as for example magnesium, aluminum, stainless steel, titanium, copper or gold, except for a material prone to corrode, by means of an arbitrary molding/working method such as press working, forging, or casting. The pad member 5 has translucency, and is formed in such a manner as to have a film structure of various rubber materials such as a silicone rubber or thermoplastic elastomers, i.e., rubber elastic bodies. Further, when the reinforcing plate 4 is made of a resin as in the Embodiments 4 to 6, it is possible to form a keypad 3, not only by means of insert molding, but also by means of what is called dichromatic molding which is performed using the combination of silicone rubbers and hard resin materials, or the combination of various thermoplastic elastomers and hard resin materials, as described below.

Figure 2:
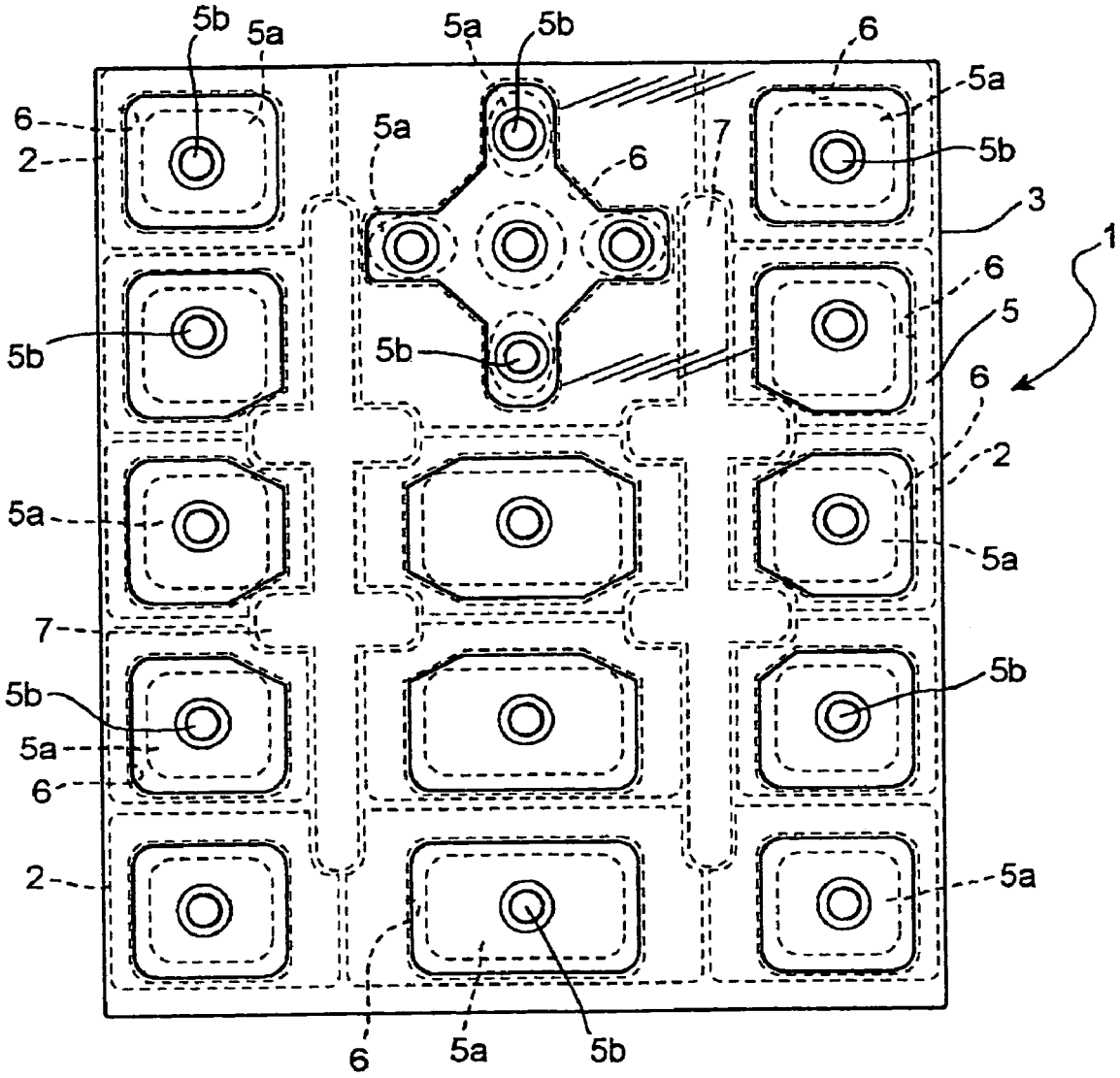
[FIG. 2]
Enlarged plan view showing the key unit with metal reinforcing plate as Embodiment 1, as seen from the reverse side (back side) of FIG. 1.
Figure 3:
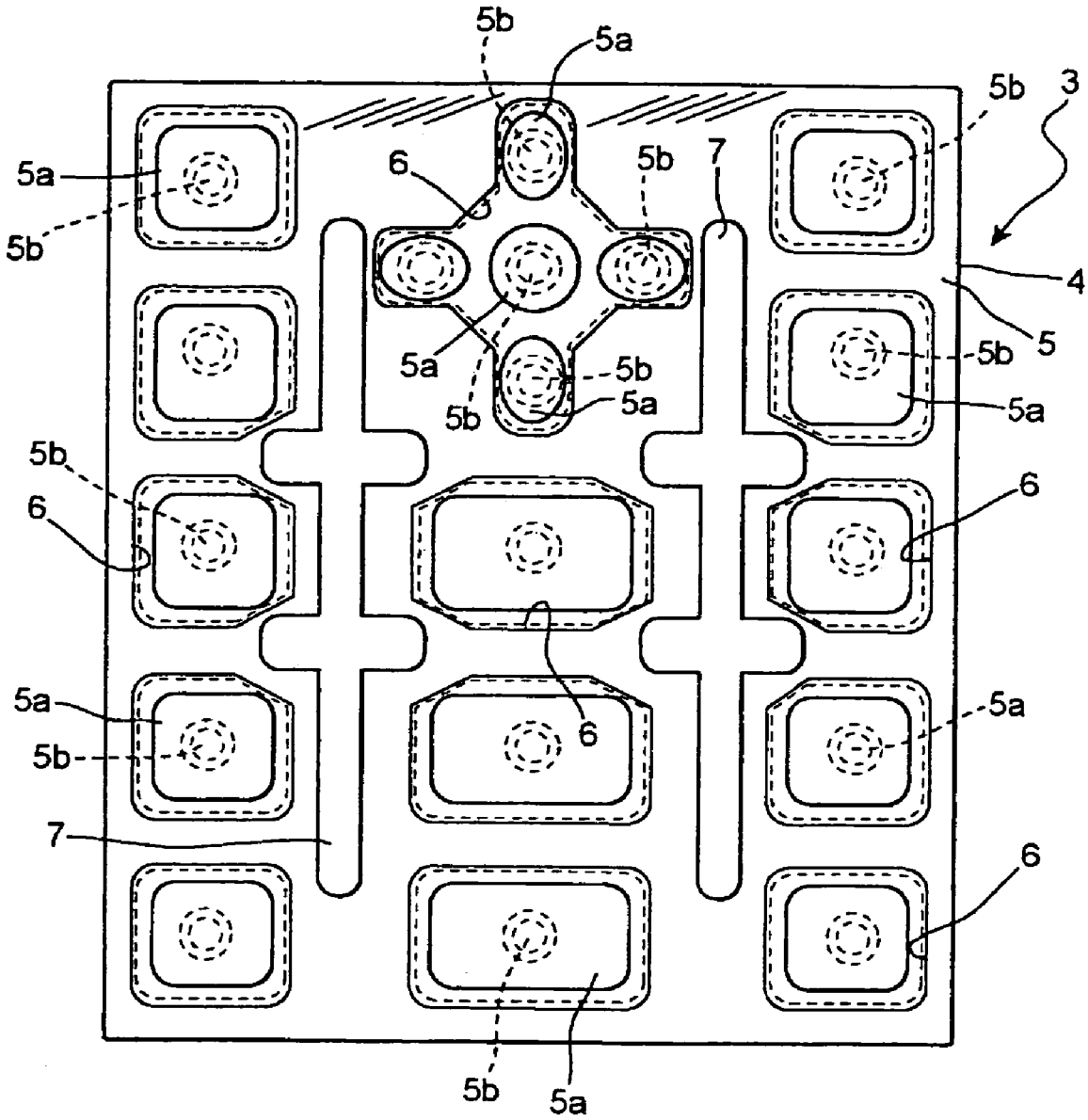
[FIG. 3]
Enlarged plan view showing a keypad of the key unit with metal reinforcing plate as Embodiment 1.
Figure 4:
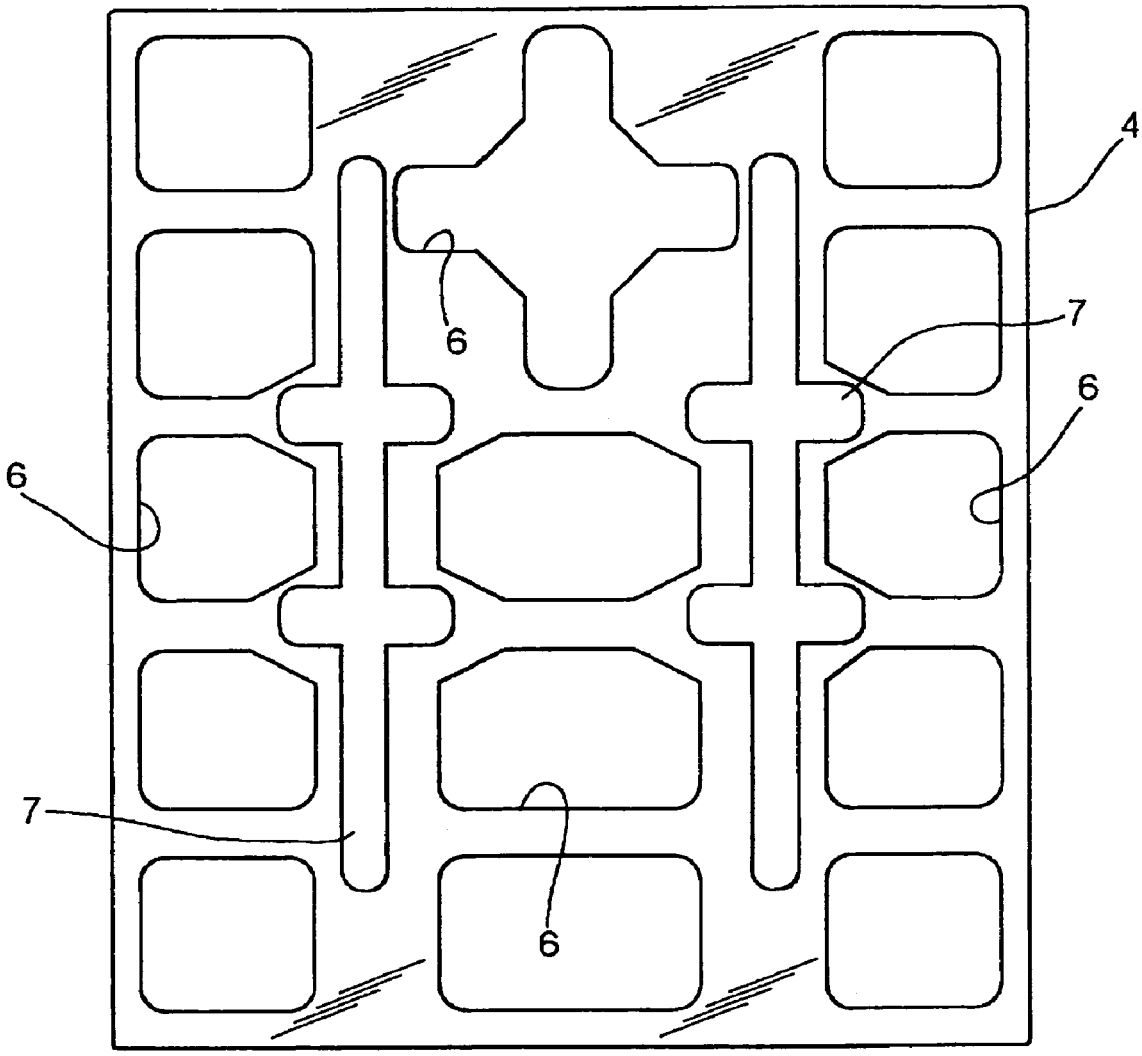
[FIG. 4]
Enlarged plan view showing a reinforcing plate for use in the key unit with metal reinforcing plate as Embodiment 1.

On the reinforcing plate 4, a multiplicity of apertures 6, 6, . . . having various shapes are formed as shown in FIGS. 2 to 4, and on a part between the apertures 6, 6, . . . , exposed parts 7, 7 are formed integrally which is protruded to one side and is exposed to the outside through the space between the key tops 2, 2, . . . .

The apertures 6, 6, . . . of the above-mentioned metal reinforcing plate 4 are sealed, respectively, by pad members 5, 5, . . . , as shown in FIGS. 2 and 3. Further, as shown in FIGS. 2, 3 and 5 to 7, the present embodiment shows that the pad member 5 is formed so as to be fixed to the reinforcing plate 4 by means of fusing or the like in such a shape as to cover the overall surface of each one of top surface and undersurface of the reinforcing plate 4 except for a part thereof, and as to sandwich the reinforcing plate 4 between the top surface and the undersurface, and shows that a part which covers each one of top surface 4*a*, undersurface 4*b*, and left side surface 4*c* and right side surface 4*d* being in contact with the aperture 6 of the reinforcing plate 4, and a part which seals each aperture 6 are integrated together. However, the shape of the pad member 5 is not limited to the above, and it may be possible to form the pad member 5, so that wherein a part which only covers one of each surface of the top surface 4*a*, the undersurface 4*b*, the inner peripheral wall (shown as the left side surface 4*c* and the right side surface 4*d* of the inner peripheral wall in the drawings) of the aperture 6, and a part which seals each aperture 6 are integrated together. In addition, it may be also possible to form the pad member 5 which only consists of a part sealing each aperture 6, with both surfaces being not covered.

Figure 5:
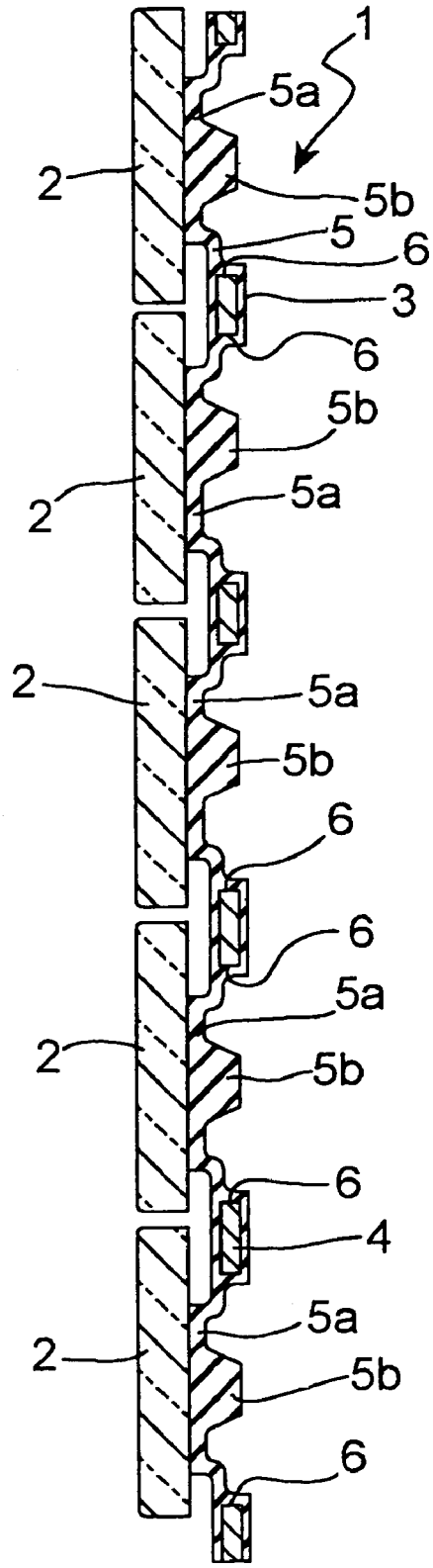
[FIG. 5]
Enlarged sectional view shown as taken along the line a-a in FIG. 1.
Figure 6:
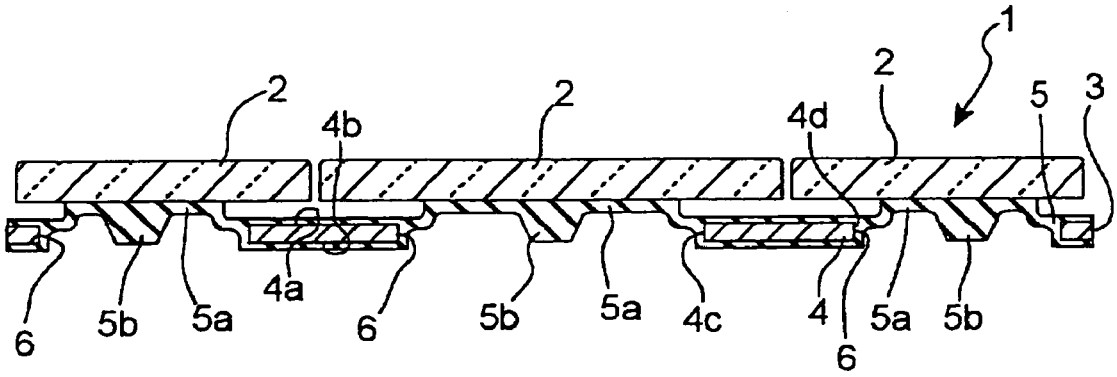
[FIG. 6]
Enlarged sectional view shown as taken along the line b-b in FIG. 1.

FIGS. 5 and 6 show a condition in which the above-mentioned pad member 5 is formed so as to cover the overall respective surfaces of the metal reinforcing plate 4. It is preferable that the metal reinforcing plate 4 should be covered throughout its respective surfaces because the inner peripheral wall of the aperture 6 is narrow and the plate 4 has low adherence to a pad member 5*a* such as silicone rubber or the like due to the unfitness therewith, but this is not an essential requirement.

On the other hand, the relationship of formation, which is described later, between a reinforcing plate 24 made of hard resin and a pad member 25 is shown in FIGS. 19 to 24, and it should be referred to. That is, it can be understood that the reinforcing plate 24 made of hard resin fits well with and has high adherence to the pad member 25 such as silicone rubber or the like, so that the pad member 25 is basically formed only in the aperture 26.

Figure 7:
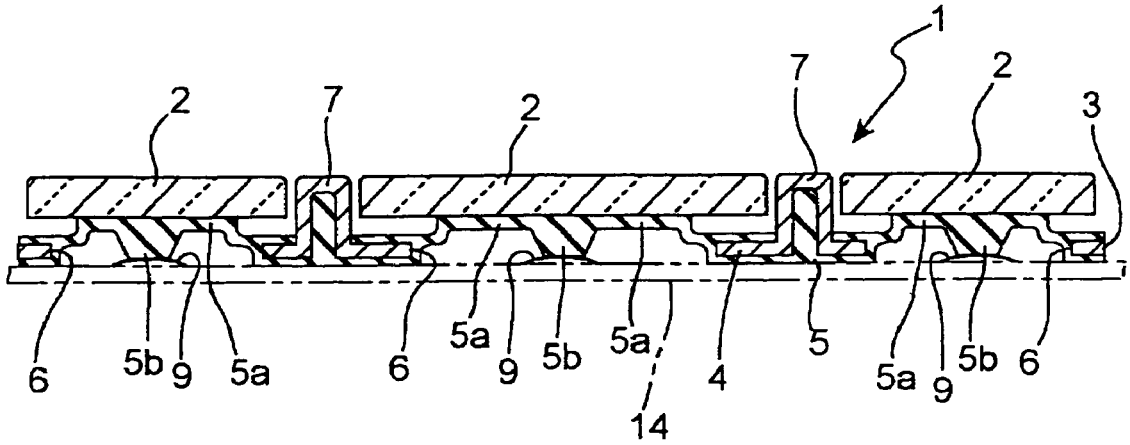
[FIG. 7]
Enlarged sectional view shown as taken along the line c-c in FIG. 1.
Figure 8:
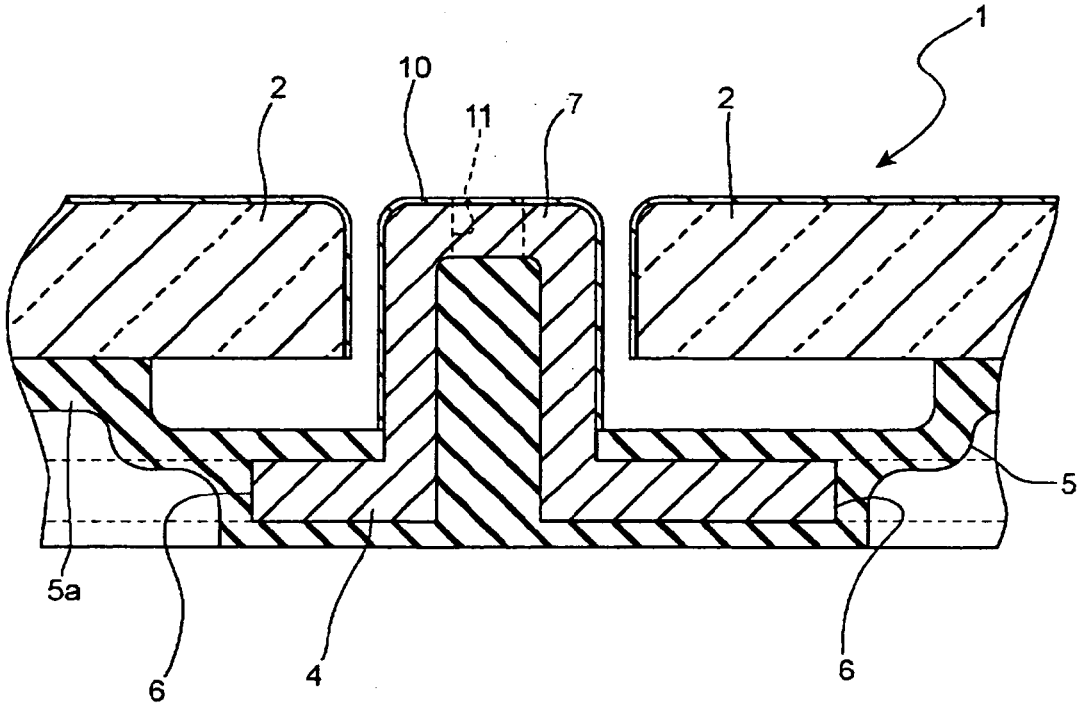
[FIG. 8]
Enlarged sectional view showing a decorative layer 10 provided on the top surface of an exposed part 7 of the metal reinforcing plate 4, in the key unit with metal reinforcing plate as Embodiment 1.

Further, the apertures 6, 6, . . . of the metal reinforcing plate 4 are sealed, respectively, by the pad members 5, 5, . . . . Each pad member 5, as shown in FIGS. 6 to 8, is fixed to the inner surface of an opening of each aperture 6 of the reinforcing plate 4; constitutes the apex of a film structure formed out of a rubber elastic body which rises in a skirt-like manner from the inside of the opening edge of the aperture 6; and has a key-fixing part 5*a* which is a part which the key top 2 is placed on and fixed to. In addition, the key top 2 is adhered and fixed to one side (top surface) of each key-fixing part 5*a* of the pad member 5 using an adhesive, and switch-pressing projections (pressing elements) 5*b*, 5*b*, . . . are formed integrally on a side opposite to the side at which the above-mentioned key-fixing part 5*a* is formed.

Moreover, in FIG. 7, an item indicated by 14 is a printed wiring board on which a multiplicity of switch elements (metal dome switches or the like) 9, 9, . . . are provided. In the present embodiment, the above-mentioned key-fixing part 5*a* is configured to be projected toward one side (upward), but it is not necessarily required to have such configuration. It may be sufficient if the switch element 9 is ensured to operate by the pressing element 5*b* when pressing the key top 2, by, for example, configuring so that the part 5*a* is positioned at the same level as the surface of the metal reinforcing plate 4.

Decorations including letters, symbols or the like which represent the function of each corresponding key are applied to the top surface or the undersurface (the surface at the side which is fixed to the pad member 5) of the key top 2, 2, . . . using above-mentioned various decoration methods. The similar decoration is also applied to exposed parts 7, 7 of the reinforcing plate 4.

That is, as shown in FIG. 8, a decorative layer 10 is formed on the surface of the exposed parts 7, 7 on the top surface of the metal reinforcing plate 4. The decorative layer 10 is constituted by a plurality of peculiar layers with various decorative methods. The plurality of layers mean, for example, a character layer on which characters such as letters or symbols are formed in a positive manner or a negative manner, an overcoat layer which imparts abrasion resistance, a coloring layer which colors letters or symbols, a foundation layer, or the like, when decorated by means of printing or painting.

The decorative layer 10 allows to decorate and create a designed feature by coloring the exposed parts 7, 7 or by forming patterns, pictures, or the like, and to form positive or negative letters, symbols, or the like in the same manner as the key. Further, as shown for example in FIG. 8, a aperture 11 may be provided on a part of the exposed part 7, so as to permeate light to the outside through the aperture 11, thereby illuminating the above-mentioned decorative layer 10 in the same manner as the key. It should be added that, for example, the exposed parts 7, 7 sometimes constitute a concave part, when seeing from the back side of the reinforcing plate 4. Thus, the concave part could be filled by the pad member 5 as shown diagrammatically, but the present invention is not limited to this configuration.

Figure 9:
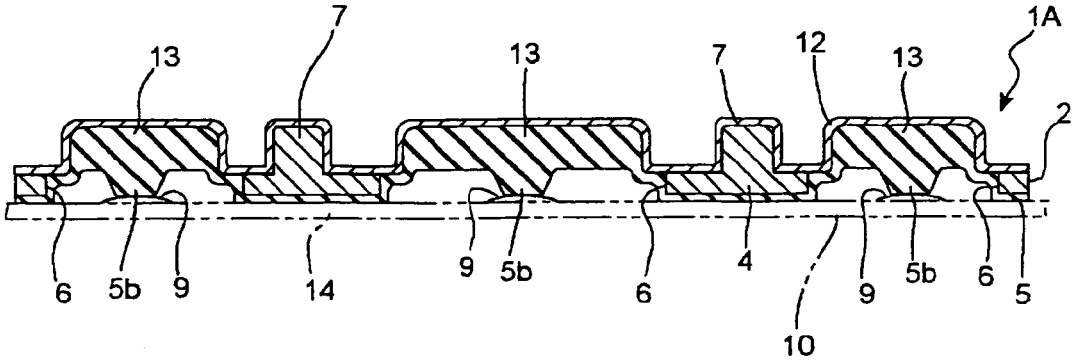
[FIG. 9]
Enlarged sectional view showing a modified example of the key unit with metal reinforcing plate as Embodiment 1.

FIG. 9 shows a modified example 1A of the key unit 1 in the above-mentioned Embodiment 1. It is added that, an explanation is omitted by using the same symbol as the one used in the above-mentioned Embodiments for the parts which have the configuration similar to the above-mentioned Embodiments For the key unit 1A, there is employed a sheet-like member 12 such as a drawn/molded membrane sheet or a plastic film of an appropriate material instead of the key top. The point which differs from the above-mentioned key unit 1 is the increased thickness of a key-fixing part 13 of each pad member 5 and its upward projection as in the case of fixing the key top. The sheet-like member 12 is adhered to the keypad 3 in such a condition as to cover the overall one surface (top surface) of the keypad 3.

That is, the sheet-like member 12 is molded three-dimensionally so as to be fit to the shapes of convex and concave of the reinforcing plate 4 (including the exposed part 7) and the pad member 5, and is in close contact with the reinforcing plate 4 and the pad member 5. This structure allows to obtain high waterproof property and dust resistance of the key part when the key unit 1A is attached to such equipment as a portable phone or the like. It should be added that the decoration similar to the above-mentioned key unit 1 is applied to the front surface or the back surface of the sheet-like member 12.

EMBODIMENT 2

Figure 10:
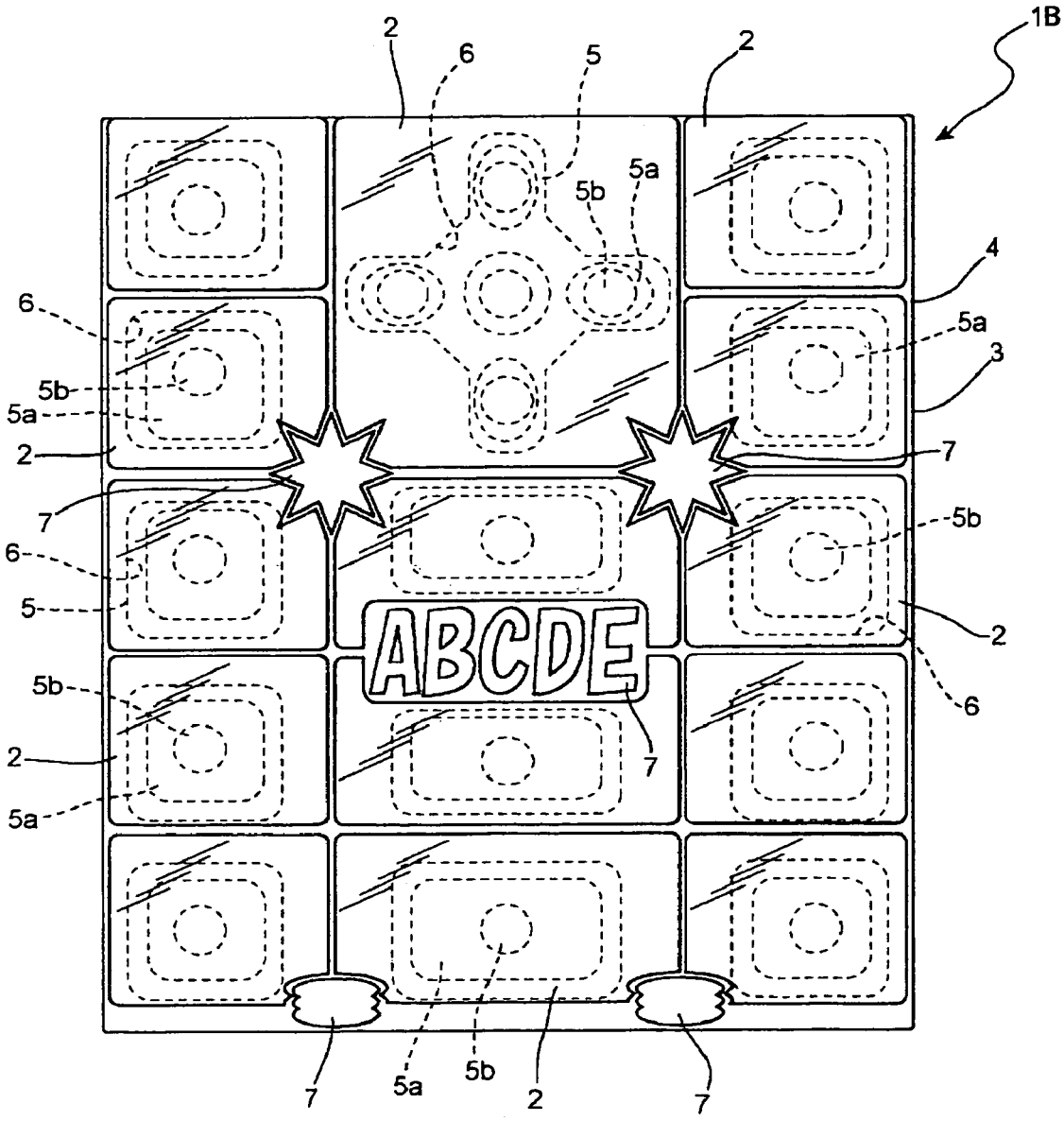
[FIG. 10]
Enlarged plan view showing the key unit with metal reinforcing plate as Embodiment 2.

FIG. 10 is plan view showing a key unit 1B with metal reinforcing plate as Embodiment 2 of the present invention. The key unit 1B differs from the above-mentioned key unit 1 only in the shape and the number of the exposed part of the metal reinforcing plate 4. Therefore, an explanation is omitted by using the same symbol as the one used in the above-mentioned Embodiments for the parts which have the configuration similar to the above-mentioned Embodiments. That is, the key unit 1B is an example in which, as shown in FIG. 10, five locations between the keys of the reinforcing plate 4 are exposed through the space between the key tops 2, 2, . . . as the exposed parts 7, 7, . . . , so that each exposed part 7 is formed into an appropriate shape such as a star shape or a dumpling shape, or into an arbitrary letter string of "ABCDE."

Thus, in the key unit 1B, it is possible to freely set the number and the shape of the exposed parts 7, 7, of the metal reinforcing plate 4. In addition, selecting various decorations to be applied to the exposed parts 7, 7, . . . allows to bring a novel effect in the aspect of design to the key unit 1 B and the equipment using it.

EMBODIMENT 3

Figure 11:
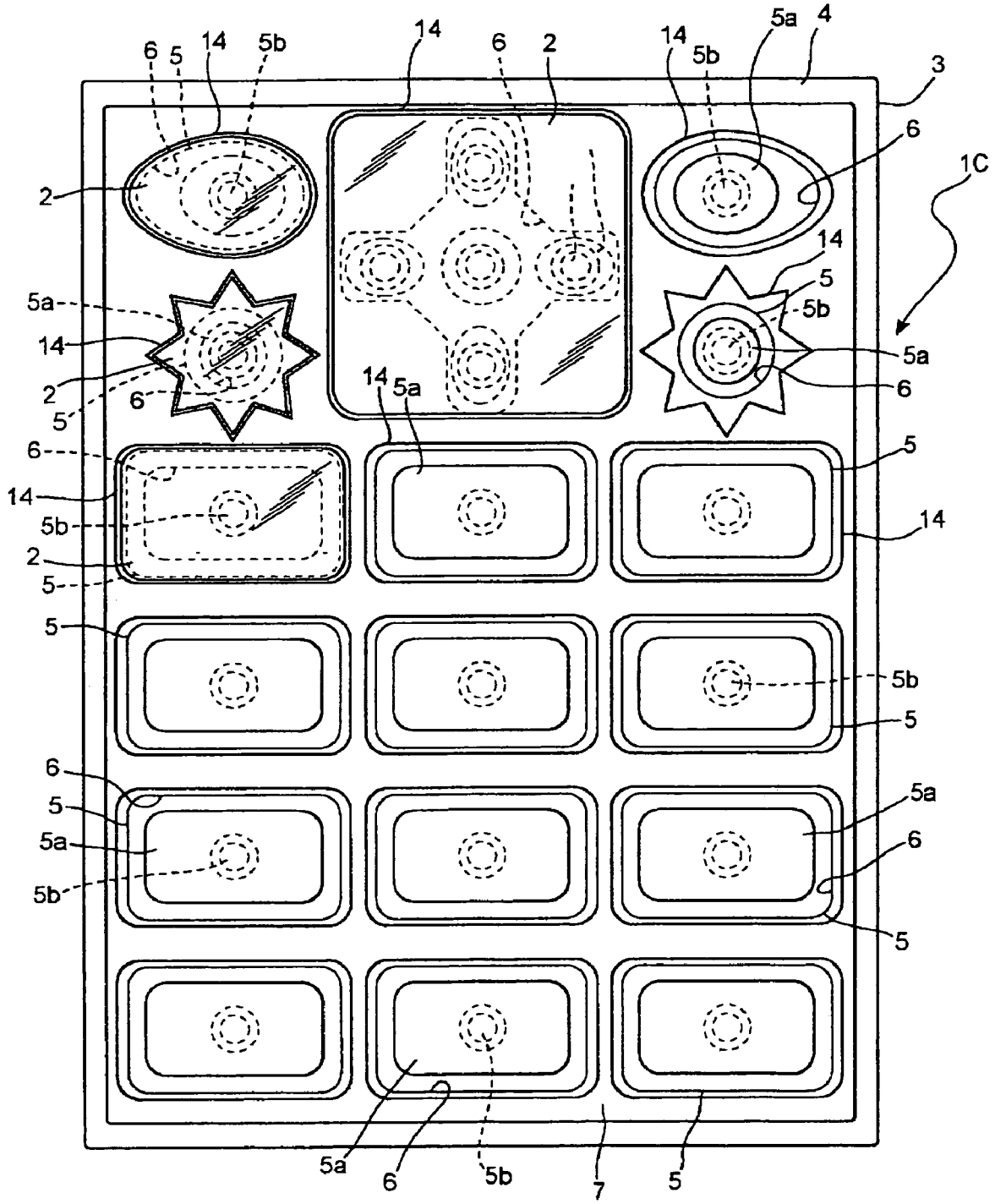
[FIG. 11]
Enlarged plan view showing the key unit with metal reinforcing plate as Embodiment 3.
Figure 12:
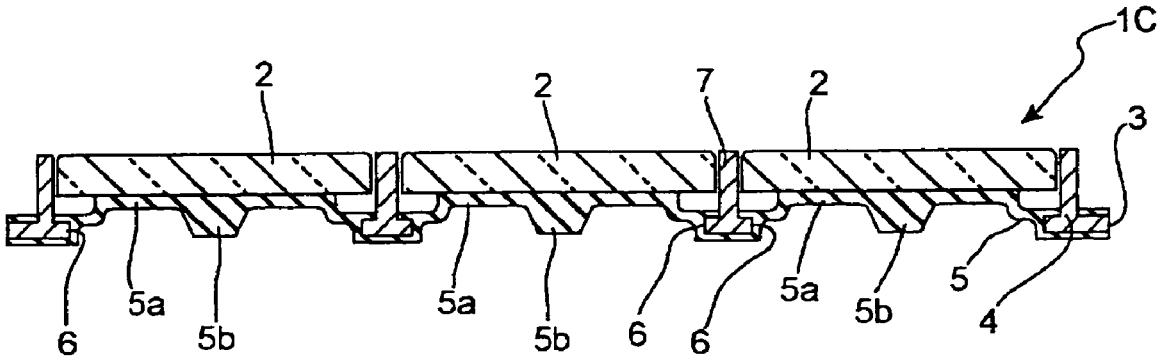
[FIG. 12]
Enlarged sectional view showing the key unit with metal reinforcing plate as Embodiment 3.
Figure 13:
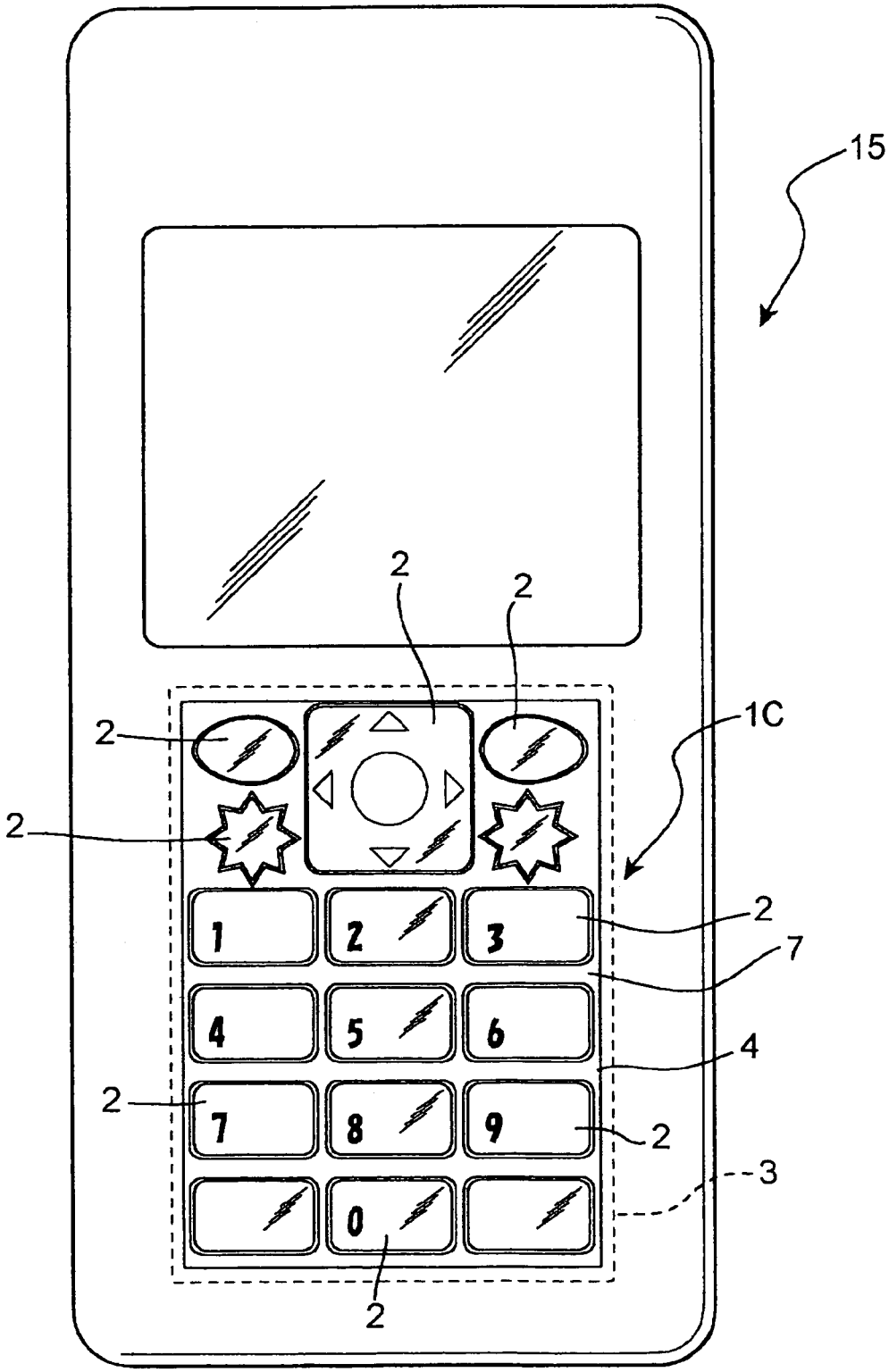
[FIG. 13]
Plan view showing a portable phone with the key unit with metal reinforcing plate as Embodiment 3 built into.
Figure 14:
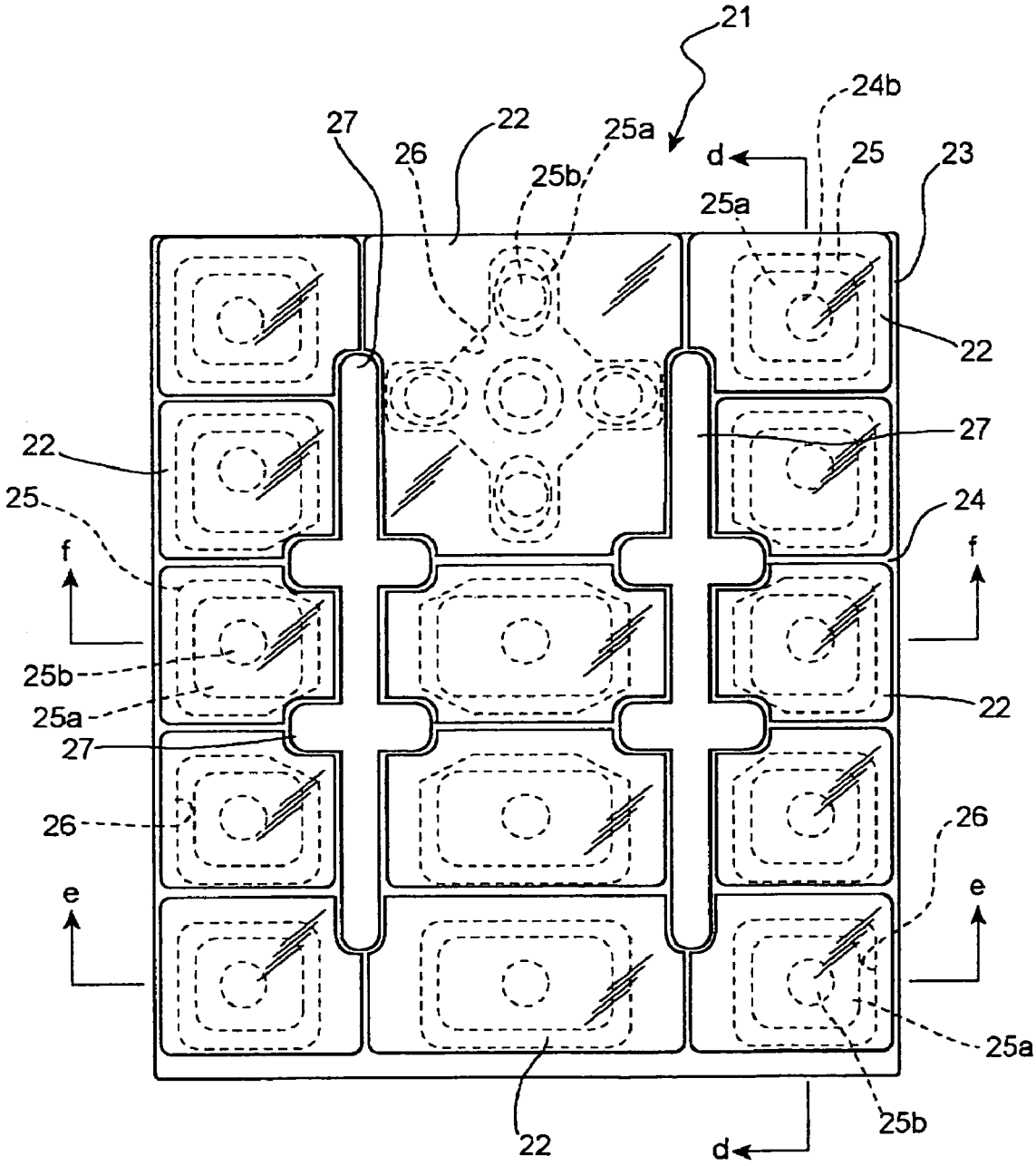
[FIG. 14]
Plan view showing a key unit with hard resin reinforcing plate as Embodiment 4.
Figure 15:
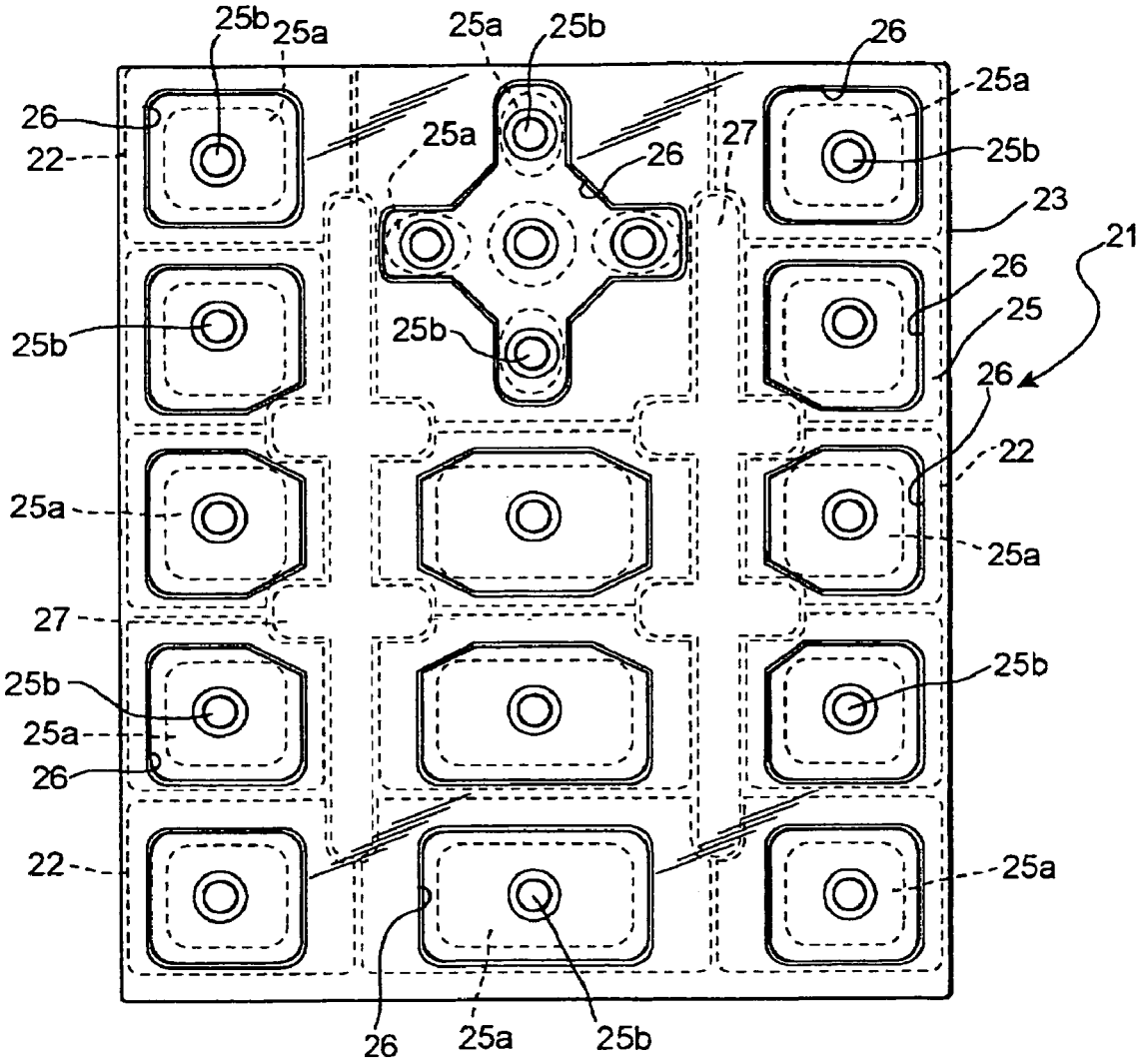
[FIG. 15]
Plan view showing the key unit with hard resin reinforcing plate as Embodiment 4, as seen from the reverse side (back side) of FIG. 1.
Figure 16:
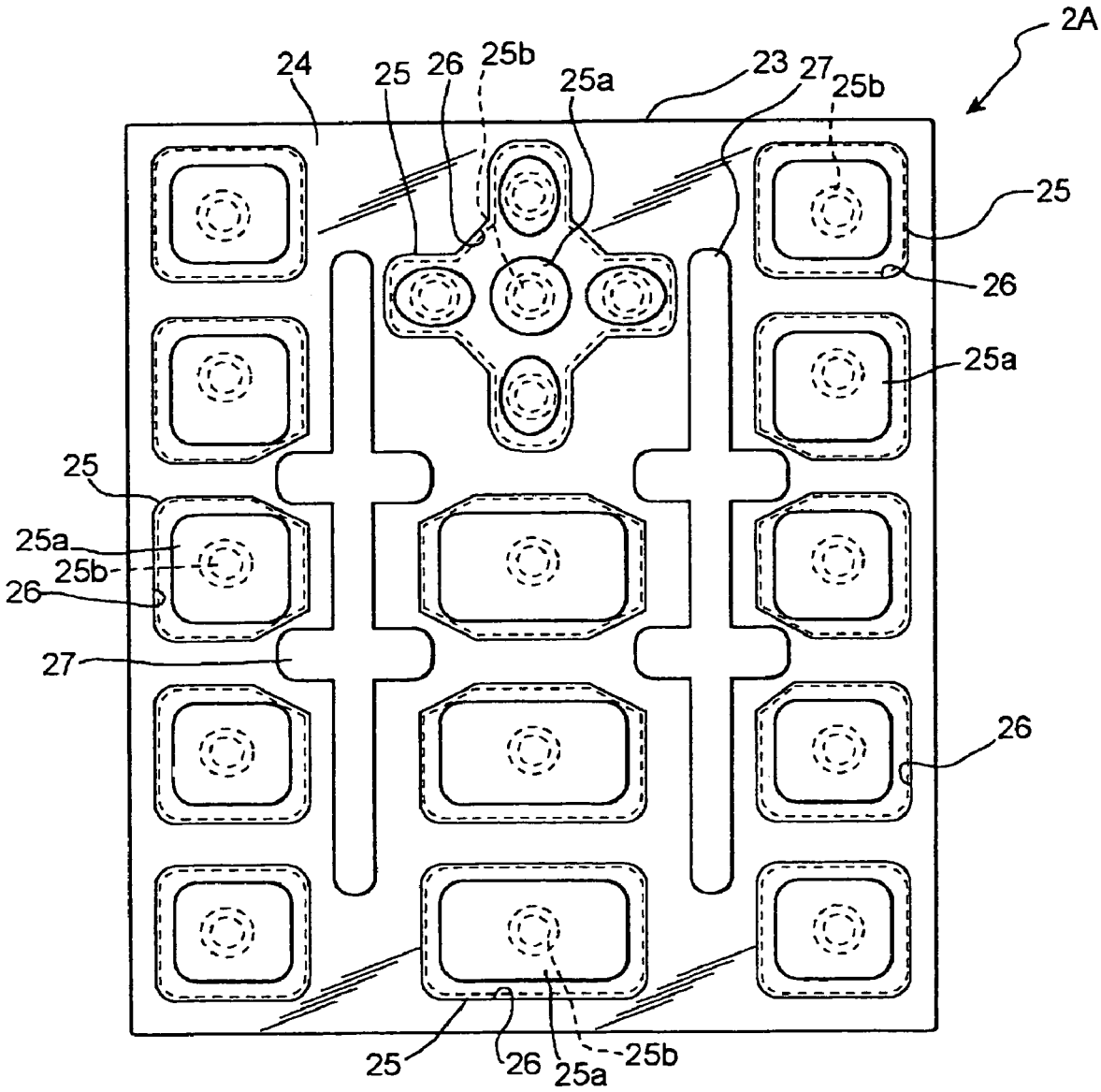
[FIG. 16]
Plan view showing a keypad, in the key unit with hard resin reinforcing plate as Embodiment 4.
Figure 17:
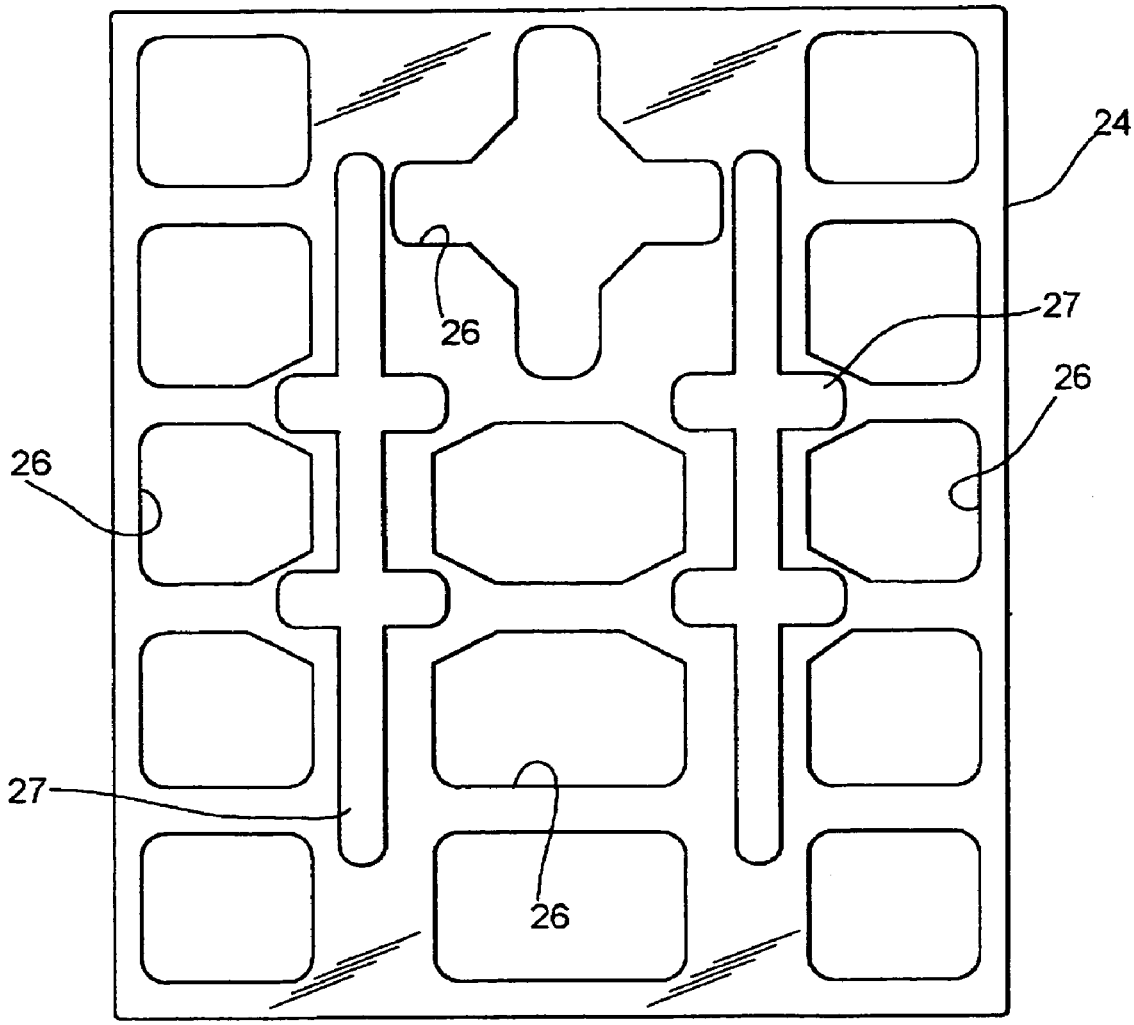
[FIG. 17]
Plan view showing a reinforcing plate for use in the key unit with hard resin reinforcing plate as Embodiment 4.

FIGS. 11 and 12 show a key unit 1C with metal reinforcing plate as Embodiment 3. The key unit 1C differs from each of the above-mentioned Embodiments in the shape of the keypad 3, and show an example in which the exposed part 7 of the reinforcing plate 4 is entirely exposed through the space between each of the key tops 2, i.e., the exposed part 7 is formed integrally so as to surround the perimeter of the key tops 2, 2, . . . entirely. That is, in the reinforcing plate 4, apertures 6, 6, . . . in which the pad members 5, 5 . . . are arranged, and other parts except one part of the perimeter of the opening edge of the apertures 6, 6, . . . are protruded to the one side as the exposed part 7. The apertures 6, 6, . . . and parts 14, 14, on which the key tops 2, 2, . . . of the reinforcing plate 4 constituted by a part of the perimeter of its opening edge is placed have relatively concave shapes. Further, FIG. 13 shows one example 15 of a portable phone into which the above-mentioned key unit 1C is incorporated.

Thus, the key unit 1C, which differs from the conventional one which has a key frame, can bring a novel effect in the aspect of design to the portable phone 15, by means of various decorations and illuminations which are applied to the exposed part 7 of the metal reinforcing plate 4 corresponding to the key frame.

EMBODIMENT 4

FIGS. 14 to 24 show Embodiment 4 of a key unit having a reinforcing plate made of a hard resin which is modified from the one made of a metal shown in Embodiments 1 to 3. In the present Embodiment, a part of the hard resin reinforcing plate is exposed in the shape of two inequality symbols between the key clusters which constitute three columns as a whole.

Key unit 21 has key tops 22, 22 . . . , which are formed in a desired shape, and a keypad 23. The keypad 23 comprises a hard resin reinforcing plate 24 which shapes like a plate on the whole, and pad members 25, 25, . . . which constitute key operation parts. That is, in Embodiments 4 to 6, a composite member comprising the hard resin reinforcing plate 24 and the pad member 25 is referred to as the keypad 23. The key top 22 and the reinforcing plate 24 are formed out of a hard resin which has excellent transparency such as PC, PET, PMMA or the like. The pad member 25 has translucency, and is formed in such a manner as to have a film structure of various rubber materials such as a silicone rubber or thermoplastic elastomers, i.e., rubber elastic bodies. The keypad 23 is formed, for example, by insert molding of the reinforcing plate 24 which has already been formed when the pad members 25, 25, . . . are molded. Further, it should be added that for the key unit 21, what is called narrow pitch keys are employed in which a gap between each key top 22 is 0.3 mm or less (preferably about 0.1 mm).

On the reinforcing plate 24, a multiplicity of apertures 26, 26, . . . having various shapes are formed as shown in FIGS. 14 to 17, and on a part between the apertures 26, 26, . . . , exposed parts 27, 27 are formed integrally which is protruded to one side and is exposed to the outside through the space between the key tops.

Figure 19:
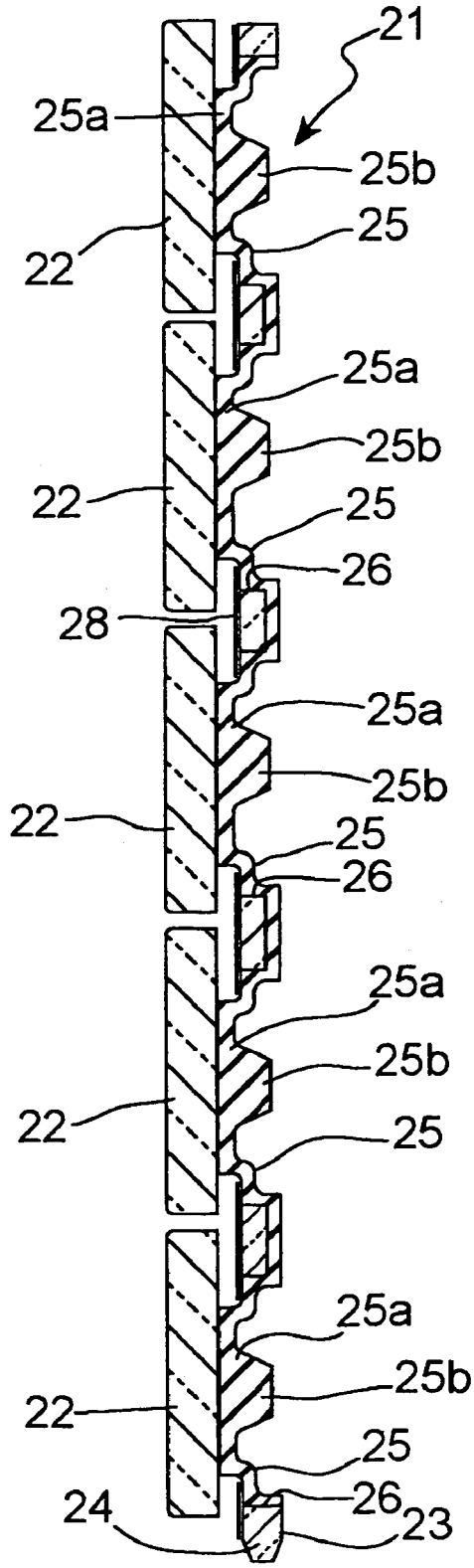
[FIG. 19]
Sectional view taken along the line d-d in FIG. 1.
Figure 20:
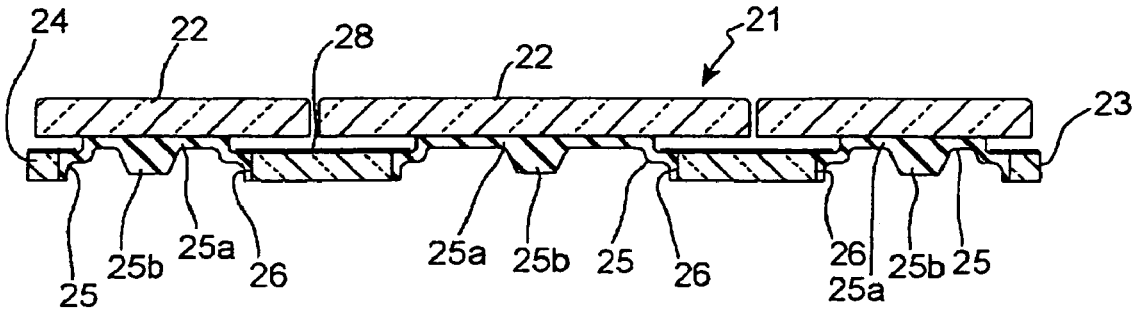
[FIG. 20]
Sectional view taken along the line e-e in FIG. 1.
Figure 21:
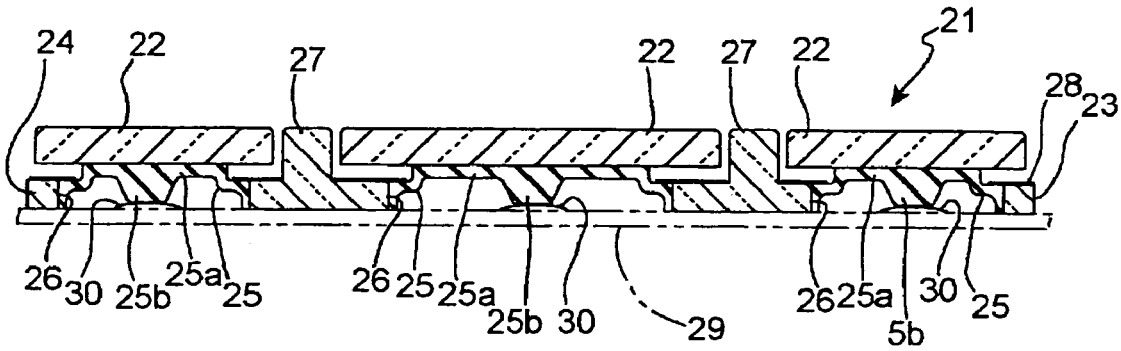
[FIG. 21]
Sectional view taken along the line f-f in FIG. 1.

Further, the apertures 26, 26, . . . of the hard resin reinforcing plate 4 are sealed respectively only partially by the pad members 25, 25, . . . . Each pad member 25, as shown in FIGS. 19 to 21 which are the sectional views along the lines d-d to f-f in FIG. 1, is fixed to the inner surface of an opening of each aperture 26 of the hard resin reinforcing plate 24; constitutes the apex of a film structure formed out of a rubber elastic body which rises in a skirt-like manner from the inside of the opening edge of the aperture 26; and has a key-fixing part 25*a*, which the key top 22 is placed on and fixed to. In addition, the key top 22 is adhered and fixed to one side (top surface) of each key-fixing part 25*a* of the pad member 25 using an adhesive or the like, and switch-pressing projections (pressing elements) 25*b*, 25*b*, are formed integrally on a side opposite to the side at which the above-mentioned key-fixing part 25*a* is formed.

Figure 18:
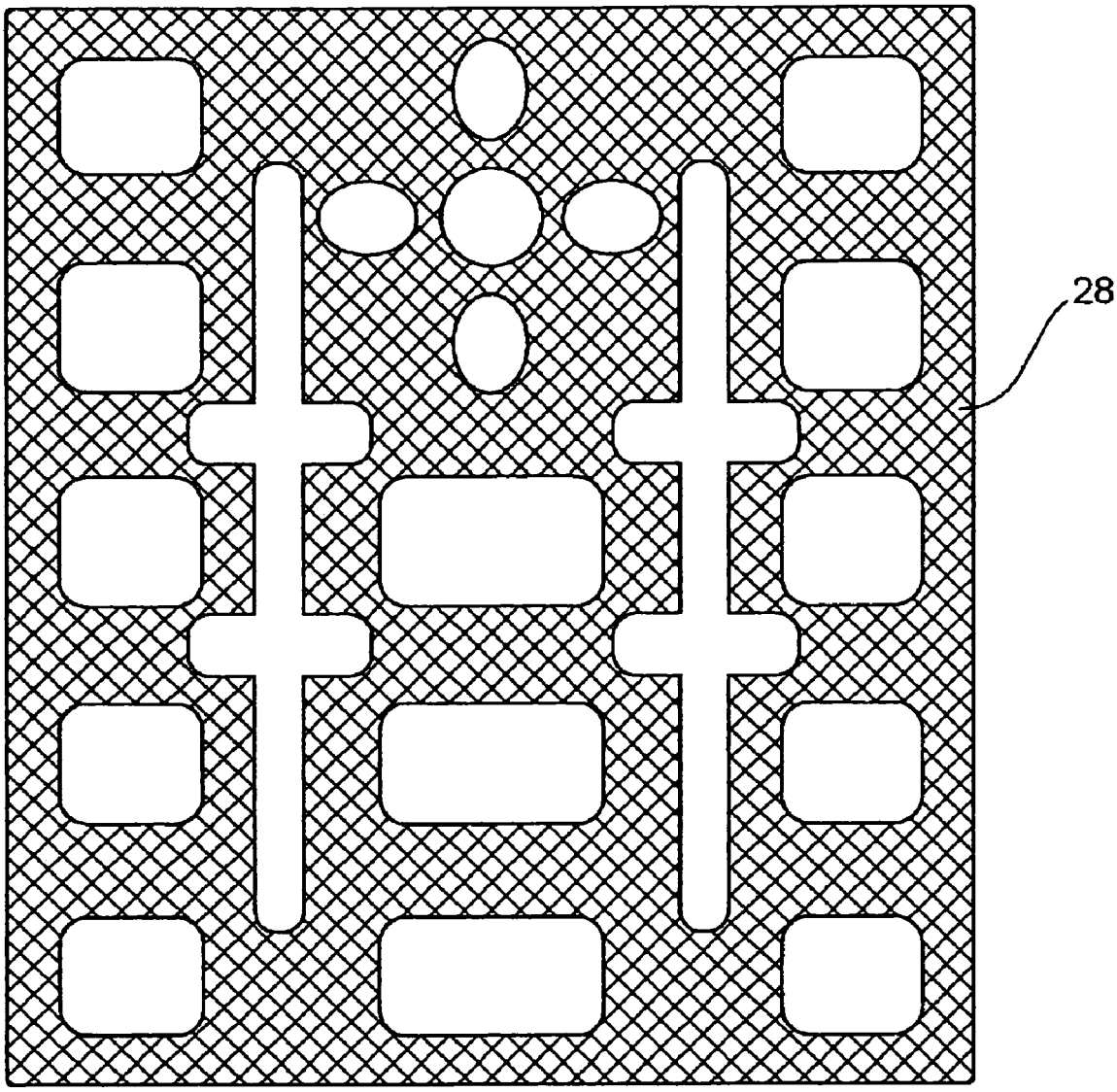
[FIG. 18]
Plan view showing a shading sheet for use in the key unit with hard resin reinforcing plate as Embodiment 4.

Further, a shading sheet 28 as shown in FIG. 18 is laid on the keypad 23 in such a manner as to cover the surface of other parts except the apertures 26, 26, . . . and the exposed parts 27, 27, . . . . While the shading sheet 28 does not constitute an essential requirement for the configuration of the key unit 21, it is preferable to use it during illumination in order to prevent the leakage of light through the space between the keys and between the key and the exposed part 27.

Moreover, in FIG. 21 which is a sectional view along the line f-f in FIG. 1, indicated by chain double-dashed line with reference number 29 is a printed wiring board on which a multiplicity of switch elements (such as metal dome switches or the like) 30, 30, . . . or the like, are provided. In the present embodiment, the above-mentioned key-fixing part 25*a* is configured to be projected toward one side (upward), but it is not necessarily required to have such structure. It may be sufficient if the switch element 30 is ensured to operate by the pressing element 25*b* when pressing the key top 2, by, for example, configuring so that the part 25*a* is positioned at the same level as the surface of the hard resin reinforcing plate 24.

Decorations including letters, symbols, or the like which represent the function of each corresponding key are applied to the top surface or the undersurface (the surface at the side which is fixed to the pad member 25) of the key top 22, 22, . . . by means of various decoration methods. The similar decoration is also applied to exposed parts 27, 27 of the reinforcing plate 24.

Figure 22:
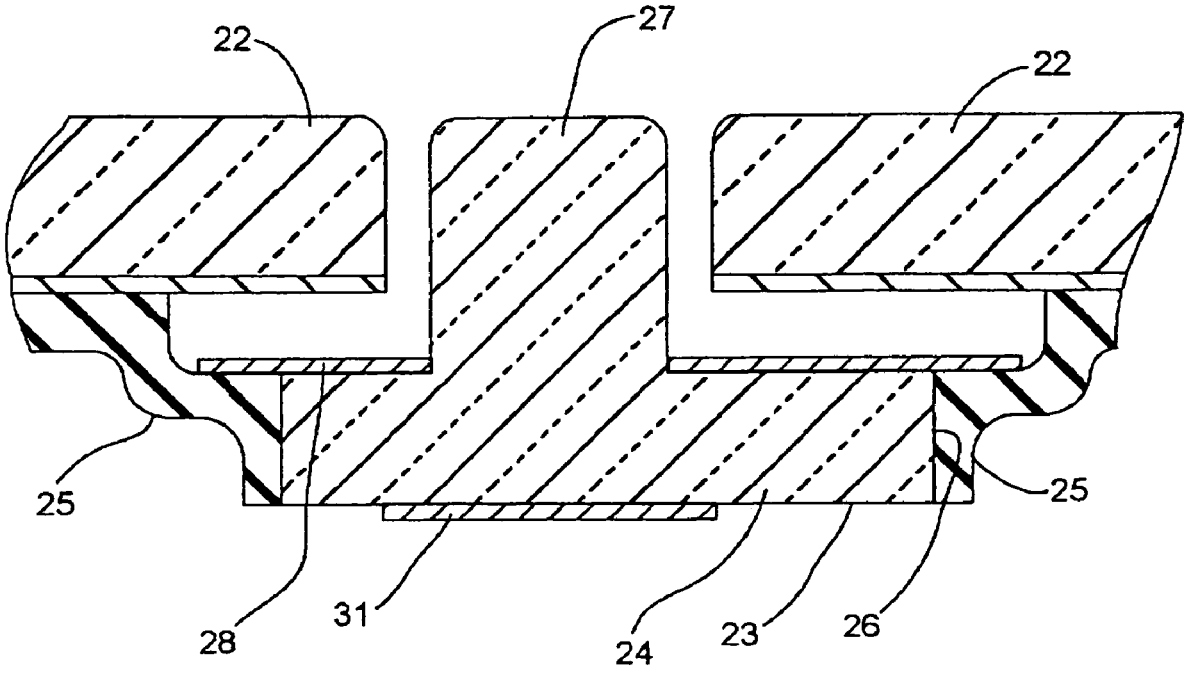
[FIG. 22]
Figure 23:
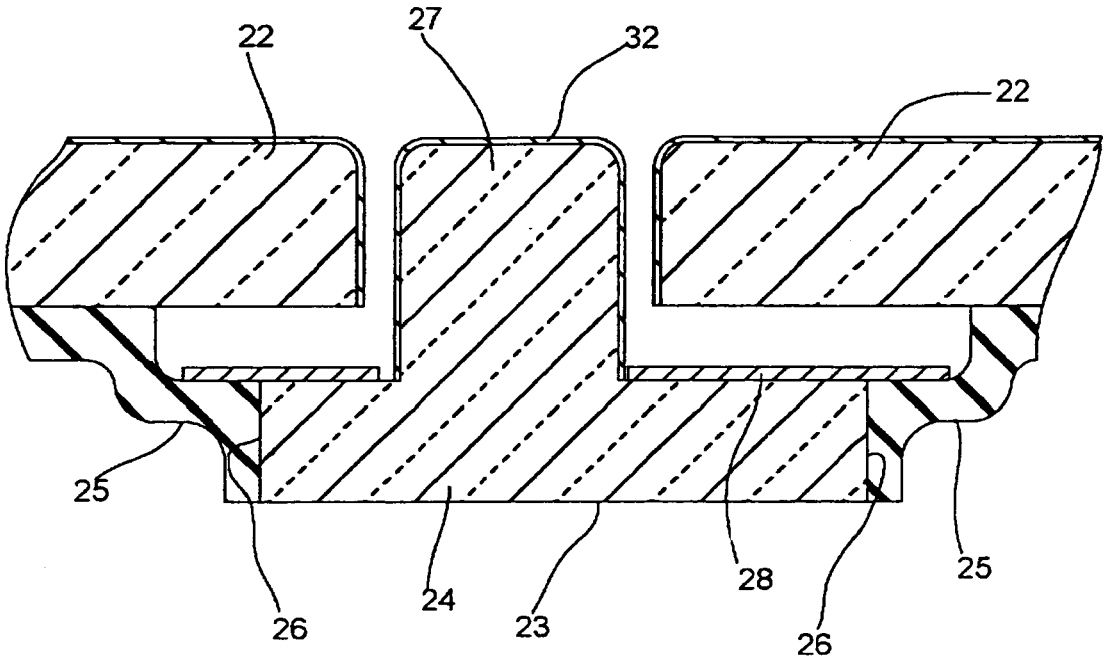
Figure 24:
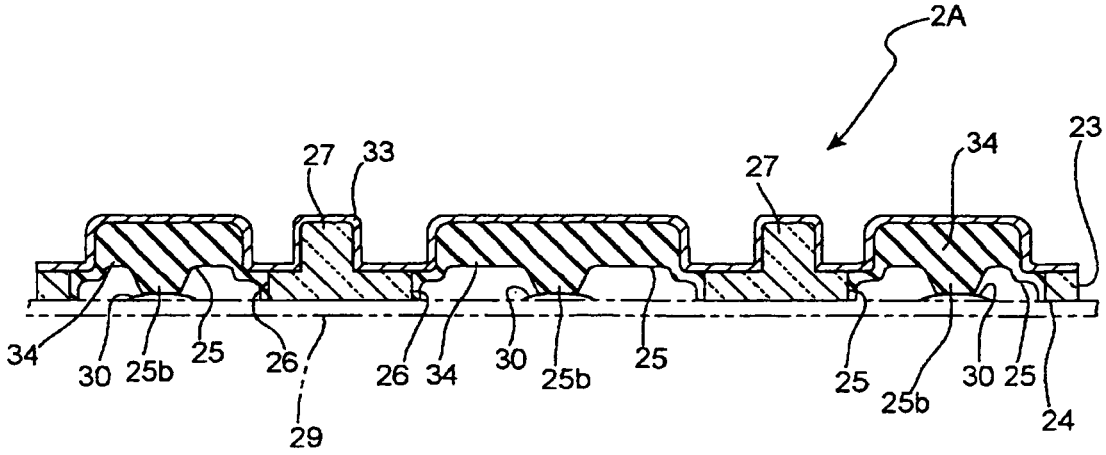

That is, as shown in FIG. 22, which is an enlarged partial sectional view of FIG. 21, a decorative layer 31 is provided by arbitrary means on a position corresponding to the exposed parts 27, 27 of the hard resin reinforcing plate 24 and on the surface (undersurface) of a side opposite to the side at which the exposed parts 27, 27 are protruded. Further, providing appropriate aperture parts allows to also illuminate decorative layers 31 and 32 in the same manner as the keys. In an example shown in FIG. 23, a decorative layer 32 is formed on the surfaces of the exposed parts 27, 27 on the top surface of the hard resin reinforcing plate 24. The above-mentioned decorative layers 31 (see FIG. 22) and 32 (see FIG. 23) are constituted by a plurality of peculiar layers with various decoration methods.

The above plurality of layers mean, for example, a character layer which forms characters such as letters or symbols in a positive manner or a negative manner, an overcoat layer which imparts abrasion resistance, a coloring layer which colors letters or symbols, a foundation layer, or the like, when decorating the surface by means of printing or painting. The decorative layers 31, 32 allows not only to decorate and create a designed feature by coloring the exposed parts 27, 27 or by forming patterns or pictures, but also to form positive or negative letters, symbols, or the like in the same manner as the key. Further, an appropriate hole for light permeation may be provided on the exposed part 27, so as to illuminate the decorative layer in the same manner as the key.

Figure 25:
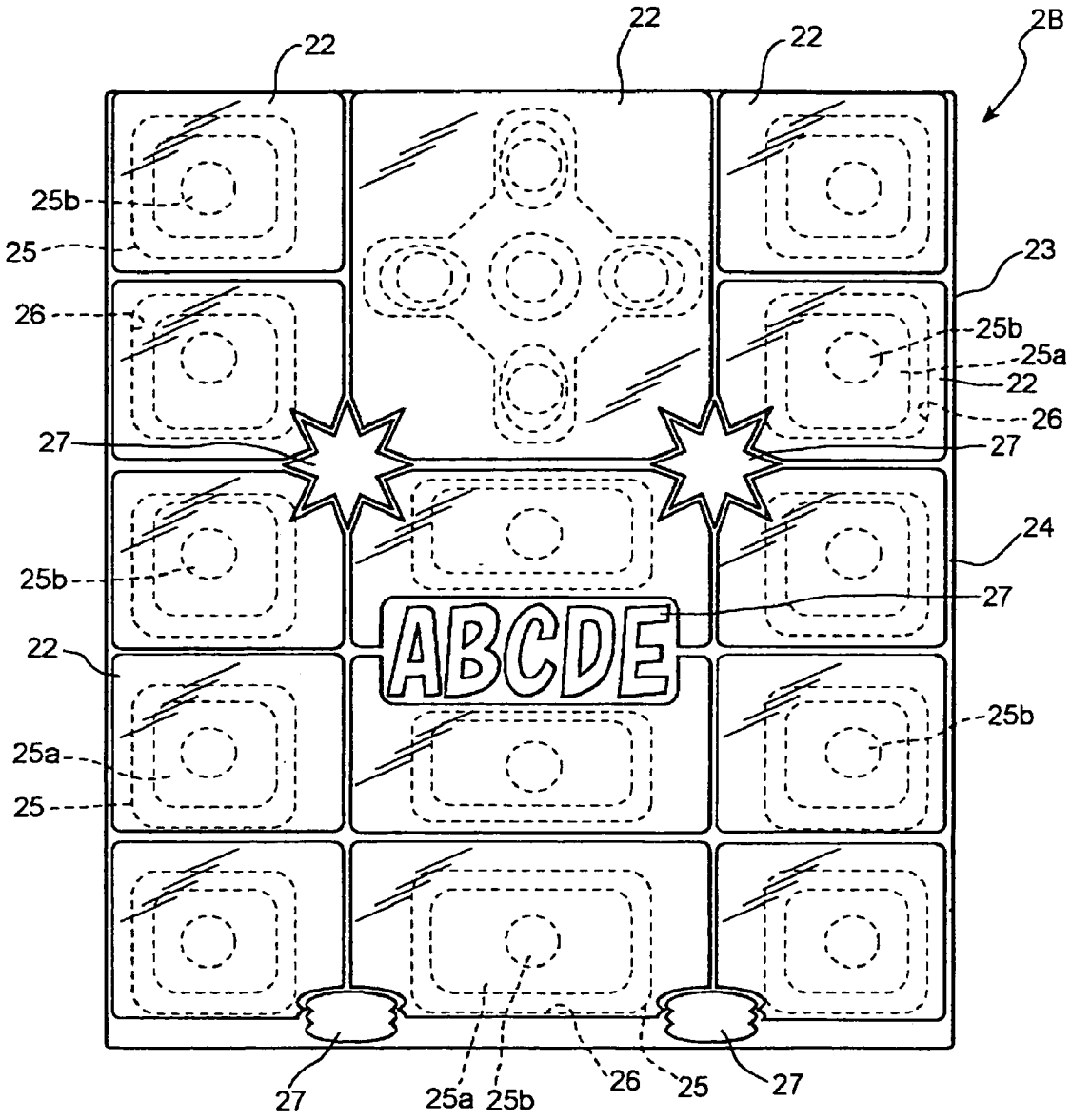

FIG. 25 shows a modified example 2A of the key unit 21 in the above-mentioned embodiment 4. It is added that, an explanation is omitted by using the same symbol as the one used in the above-mentioned Embodiments for the parts which have the configuration similar to the above-mentioned Embodiments.

For the key unit 2A, there is employed a sheet-like member 33 such as a drawn/molded membrane sheet or a plastic film of an appropriate material instead of the key top. The point which differs from the above-mentioned key sheet 21 is the increased thickness of a key-fixing part 34 of each pad member 25 and its upward projection as in the case of fixing the key top. The sheet-like member 13 is adhered to the keypad 23 in such a condition as to cover the overall one surface (top surface) of the keypad 23. That is, the sheet-like member 33 is molded three-dimensionally by means of drawing/molding so as to be fit to the shapes of convex and concave of the hard resin reinforcing plate 24 (including the exposed part 27) and the pad members 25, 25, . . . and is in,close contact with the reinforcing plate 24 and the pad members 25, 25, . . . . This configuration allows to obtain high waterproof property and dust resistance of the key part when the key unit 2A is attached to such equipment as a portable phone or the like. It should be added that the decoration similar to the above-mentioned key unit 21 is applied to the front surface or the back surface of the sheet-like member 33.

EMBODIMENT 5

FIG. 25 is a plan view showing a key unit 2B with hard resin reinforcing plate as Embodiment 5 of the present invention. The key unit 2B differs from the above-mentioned key unit 21 shown in FIG. 14 only in the shape and the number of the exposed part of the hard resin reinforcing plate 24. Therefore, an explanation is omitted by using the same symbol as the one used in the above-mentioned Embodiments for the parts which have the configuration similar to the above-mentioned Embodiments. That is, the key unit 2B is an example in which, as shown in FIG. 25, five locations between the keys of the reinforcing plate 24 are exposed through the space between the key tops 22, 22, . . . as the exposed parts 27, 27, . . . , so that each exposed part 27 is formed into a shape such as a star shape or a dumpling shape, or into an arbitrary letter string of "ABCD."

Thus, in the key unit 2B, it is possible to freely set the number and the shape of the exposed parts 27, 27, . . . of the hard resin reinforcing plate 24. In addition, selecting various decorations to be applied to the exposed parts 27, 27, . . . allows to bring a novel effect in the aspect of design to the key unit 2 B and the equipment using it.

EMBODIMENT 6

Figure 26:
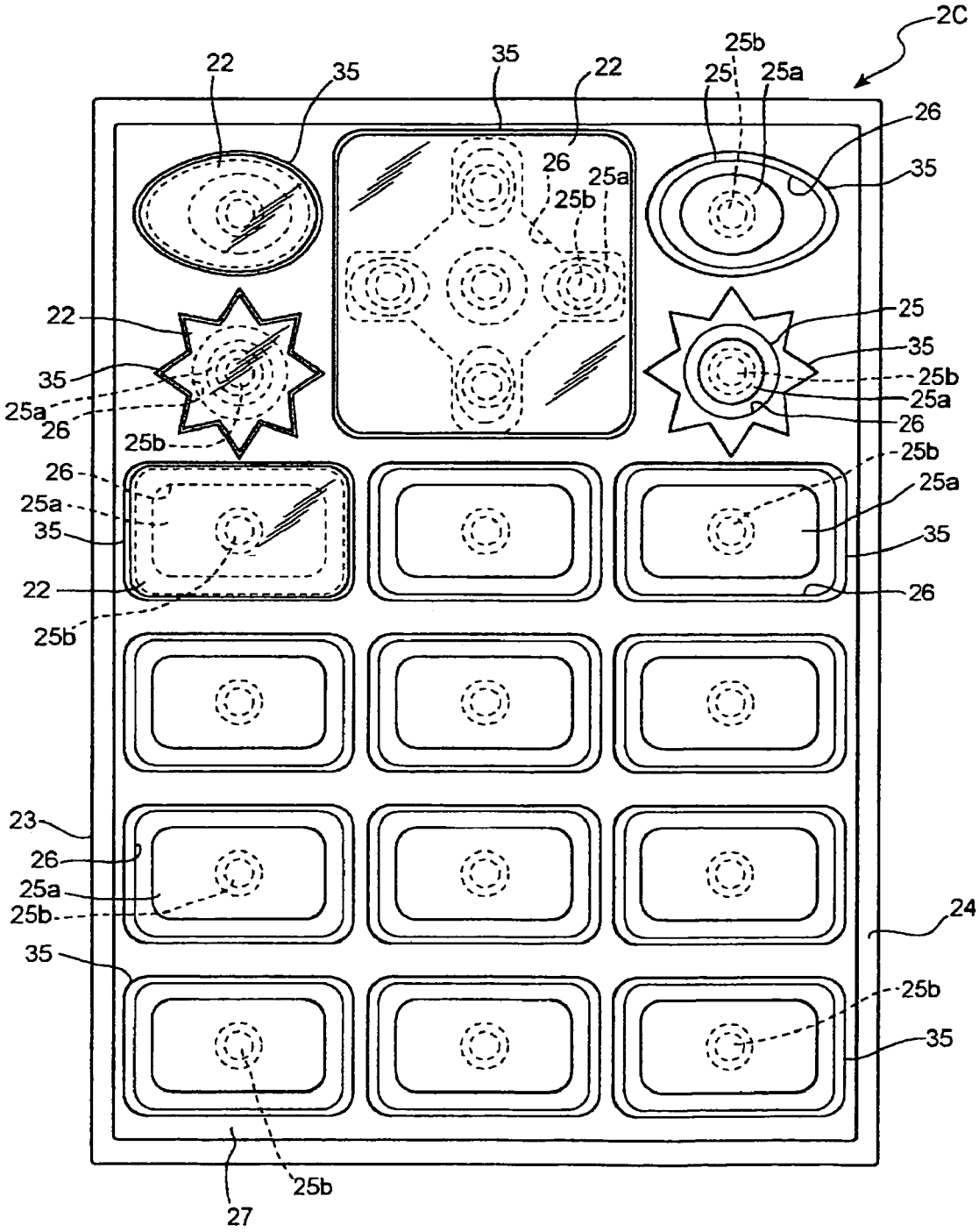
Figure 27:
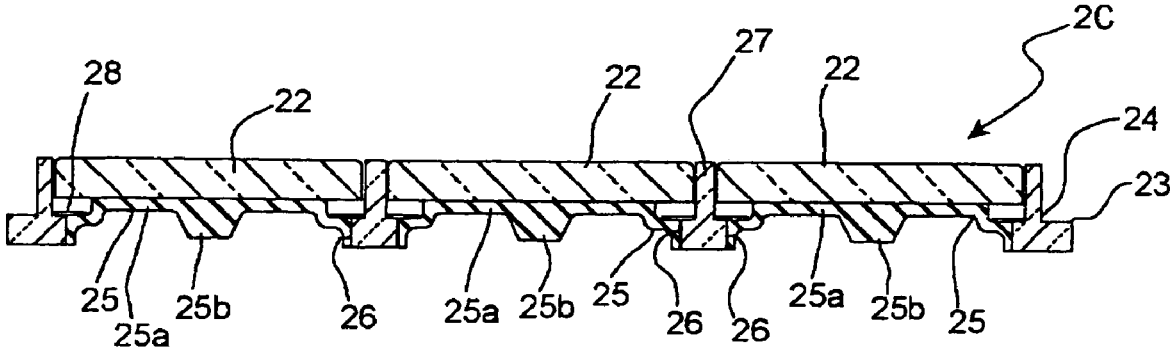
Figure 28:
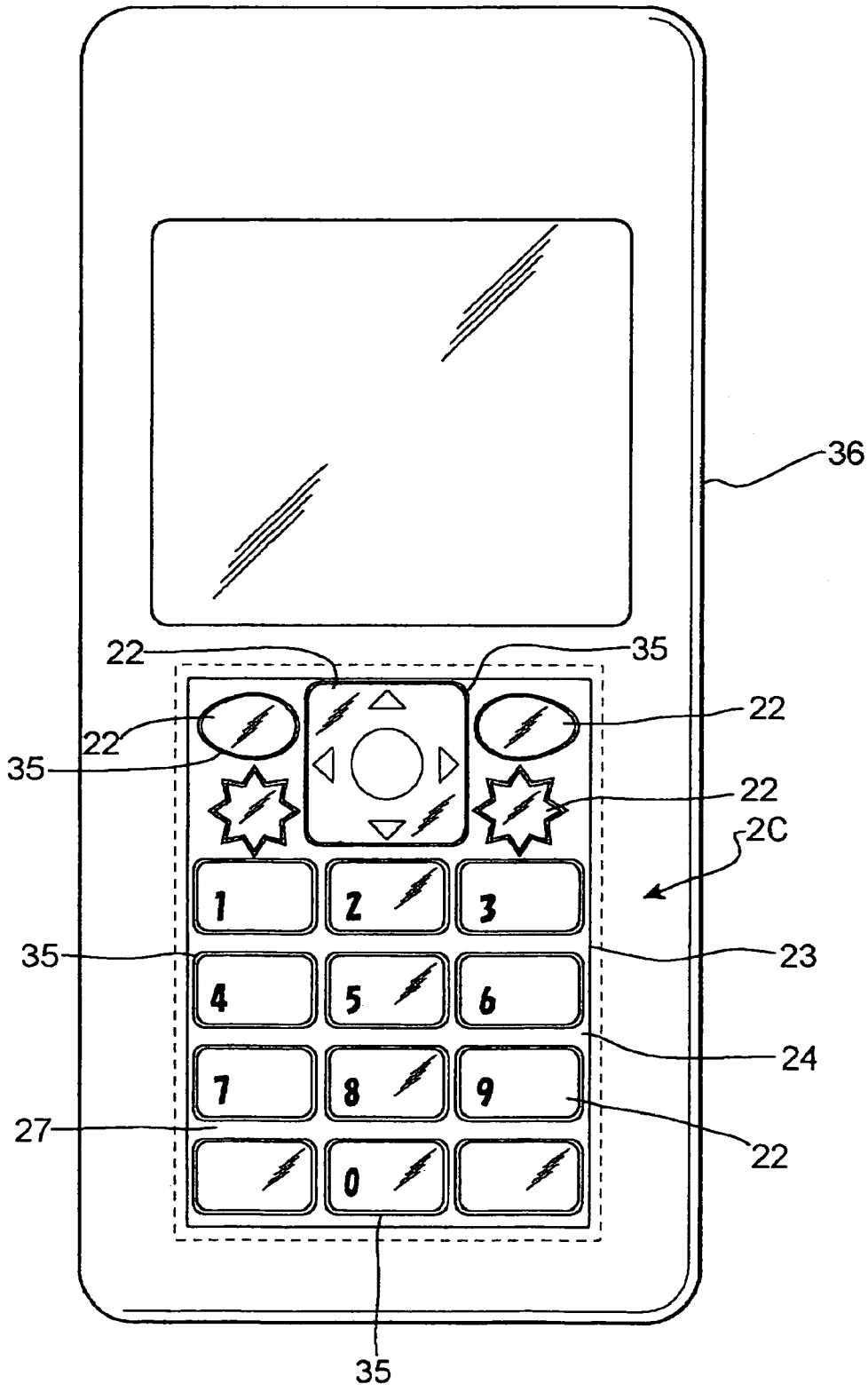

FIGS. 26 and 27 further show a key unit 2C with hard resin reinforcing plate as Embodiment 6. The key unit 2C in the present Embodiment differs from each of the above-mentioned Embodiments in the shape of the keypad 23, and show an example in which the exposed part 27 of the hard resin reinforcing plate 24 is entirely exposed through the space between each of the key tops 22, i.e., the exposed part 27 is formed integrally so as to surround the perimeter of the key tops 22, 22, . . . entirely. That is, in the reinforcing plate 24, apertures 26, 26, . . . with which the pad members 25, 25 . . . are provided, and other parts except one part of the perimeter of the opening edge of the apertures 26, 26, . . . are protruded to the one side as the exposed part 27. The apertures 26, 26, . . . and parts 35, 35, on which the key tops 22, 22, . . . of the reinforcing plate 24 constituted by a part of the perimeter of its opening edge is placed have relatively concave shapes. Further, FIG. 28 shows one example 36 of a portable phone into which the above-mentioned key unit 2C is incorporated.

Thus, the key unit 2C, which differs from the conventional one which has a key frame, can bring a novel effect in the aspect of design to the portable phone 36, by means of various decorations and illuminations which are applied to the exposed part 27 of the reinforcing plate 24, which corresponds to the key frame.

INDUSTRIAL APPLICABILITY

Since the present invention relates to a key unit for use in mobile equipment such as portable phones, personal digital assistants (PDA), or the like, it can be applicable to the development of wider industrial fields such as information communication industries which utilize these equipment, including manufacturing industries of electronic equipment and other various components.

The invention claimed is:

1. A key unit with reinforcing plate comprising a keypad in which a key operation part is formed out of a rubber elastic body and in which other parts are formed out of or reinforced by a reinforcing plate formed out of a metal or a hard resin plate, wherein a part of said reinforcing plate is exposed on a key-arrayed surface, and a decoration is applied to said exposed part.

2. The key unit with reinforcing plate according to claim 1, wherein said part of the reinforcing plate is exposed between the keys on the key-arrayed surface; exposed on the key-arrayed surface in such a manner as to encircle each individual key; or exposed on the key-arrayed surface in such a manner as to encircle a plurality of key clusters.

3. The key unit with reinforcing plate according to claim 1, wherein said part of the exposed reinforcing plate is formed into a shape of an arbitrary letter or a symbol.

4. The key unit with reinforcing plate according to claim 1, wherein said reinforcing plate is formed using one or a plurality of metal materials selected from magnesium, aluminum, stainless steel, titanium, copper, gold, and an alloy thereof.

5. The key unit with reinforcing plate according to claim 1, wherein said reinforcing plate is formed using one or two kinds of resins selected from a group of transparent hard resins including PC (polycarbonate resin), PET (polyethylene terephthalate resin), and PMMA (polyacrylate resin).

6. The key-unit with reinforcing plate according to claim 1, wherein the decoration is applied to said part of the exposed reinforcing plate using an arbitrary method selected from a group of methods including printing (including hot stamping), painting, and film-forming methods (including plating, CVD, vapor deposition, sputtering, and ion plating) with a metal or a nonmetal.

* * * * *